US009550367B2

(12) United States Patent
Sugahara et al.

(10) Patent No.: US 9,550,367 B2
(45) Date of Patent: Jan. 24, 2017

(54) LIQUID CONSUMING APPARATUS

(71) Applicant: BROTHER KOGYO KABUSHIKI KAISHA, Nagoya-shi, Aichi-ken (JP)

(72) Inventors: Hiroto Sugahara, Ama (JP); Kenta Hayashida, Inazawa (JP); Taro Nagano, Nagoya (JP); Ayako Ohishi, Nagoya (JP); Hirofumi Kondo, Aichi-ken (JP); Suguru Tomoguchi, Okazaki (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/494,250

(22) Filed: Sep. 23, 2014

(65) Prior Publication Data

US 2016/0039215 A1 Feb. 11, 2016

(30) Foreign Application Priority Data

Aug. 6, 2014 (EP) ..... 14180072

(51) Int. Cl.
*B41J 2/175* (2006.01)

(52) U.S. Cl.
CPC ..... *B41J 2/17566* (2013.01); *B41J 2/17513* (2013.01); *B41J 2/17523* (2013.01); *B41J 2002/17576* (2013.01)

(58) Field of Classification Search
CPC ..... B41J 2/17566
See application file for complete search history.

(56) References Cited

U.S. PATENT DOCUMENTS

| | | | | |
|---|---|---|---|---|
| 5,310,658 | A | 5/1994 | Berndt | |
| 5,956,061 | A | 9/1999 | Ahn | |
| 6,134,026 | A * | 10/2000 | Wada | 358/461 |
| 6,378,971 | B1 | 4/2002 | Tamura et al. | |
| 6,502,933 | B2 | 1/2003 | Lim et al. | |
| 8,016,376 | B2 | 9/2011 | Sugahara | |
| 8,147,047 | B2 | 4/2012 | Iwamura et al. | |
| 8,215,755 | B2 | 7/2012 | Iwamura et al. | |

(Continued)

FOREIGN PATENT DOCUMENTS

| | | |
|---|---|---|
| DE | 575988 C | 5/1933 |
| DE | 2361454 A1 | 6/1974 |

(Continued)

OTHER PUBLICATIONS

European Search Report issued in EP 14180072.2, mailed Oct. 6, 2014.

(Continued)

*Primary Examiner* — Stephen Meier
*Assistant Examiner* — John P Zimmermann
(74) *Attorney, Agent, or Firm* — Merchant & Gould

(57) ABSTRACT

A liquid consuming apparatus includes a liquid container, a detector, and a controller. The liquid container includes a movable member, and the movable member includes a detection portion. The detector is configured to output a detection signal based on the presence or absence of the detection portion in a detection position. The controller is configured to measure, based on the detection signal output from the detector, a physical quantity, based on which a velocity of the detection portion can be specified, and is configured to determine whether the physical quantity is within a threshold range.

26 Claims, 20 Drawing Sheets

(56) References Cited

U.S. PATENT DOCUMENTS

| | | | | |
|---|---|---|---|---|
| 8,469,500 | B2 | 6/2013 | Kubo et al. | |
| 8,506,060 | B2 * | 8/2013 | Tamaki | B41J 2/175 347/7 |
| 2001/0017641 | A1 | 8/2001 | Kobayashi et al. | |
| 2002/0063762 | A1 | 5/2002 | Jozef Haan et al. | |
| 2002/0122083 | A1 | 9/2002 | Hsu et al. | |
| 2009/0039002 | A1 | 2/2009 | Umeda | |
| 2009/0219310 | A1 | 9/2009 | Kondo | |
| 2010/0103231 | A1 | 4/2010 | Iwamura et al. | |
| 2010/0110154 | A1 | 5/2010 | Iwamura et al. | |
| 2011/0012953 | A1 * | 1/2011 | Nakamura | B41J 2/17513 347/19 |
| 2011/0216137 | A1 | 9/2011 | Okano | |
| 2011/0234717 | A1 | 9/2011 | Sakurai | |
| 2013/0250014 | A1 * | 9/2013 | Kubo et al. | 347/86 |
| 2016/0039209 | A1 | 2/2016 | Sugahara et al. | |
| 2016/0039210 | A1 | 2/2016 | Sugahara et al. | |

FOREIGN PATENT DOCUMENTS

| | | | |
|---|---|---|---|
| DE | 7607100 | U | 7/1976 |
| DE | 2946453 | A1 | 5/1981 |
| DE | 69319843 | T2 | 2/1999 |
| DE | 10203227 | A1 | 9/2002 |
| DE | 60115184 | T2 | 7/2006 |
| DE | 102008015099 | A1 | 9/2009 |
| EP | 1 120 259 | A2 | 8/2001 |
| EP | 2067622 | A1 | 6/2009 |
| EP | 2574473 | A1 | 4/2013 |
| GB | 1452770 A | A | 10/1976 |
| JP | 9-277560 | A | 10/1997 |
| JP | 2001-232806 | A | 8/2001 |
| JP | 2005-145126 | A | 6/2005 |
| JP | 2008-093862 | A | 4/2008 |
| JP | 2009-208297 | A | 9/2009 |
| JP | 2010-069757 | A | 4/2010 |
| JP | 2010-105238 | A | 5/2010 |
| JP | 2010-105239 | A | 5/2010 |
| JP | 2010-105268 | A | 5/2010 |

OTHER PUBLICATIONS

European Search Report issued in EP 14180071.4, mailed Sep. 25, 2014.
European Search Report issued in EP 14180069.8, mailed Sep. 25, 2014.
Related U.S. Appl. No. 14/493,565, as filed.
Related U.S. Appl. No. 14/494,125, as filed.
Office Action issued in related U.S. Appl. No. 14/494,125, mailed Apr. 27, 2015.
Engineering ToolBox.pdf downloaded from http://www.engineeringtoolbox.com/specific-gravity-liquid-fluids-d_294.html on on Apr. 17, 2015.
Engineering ToolBox.pdf downloaded from http://www.engineeringtoolbox.com/density-specific-gravity-liquid-fluids-d_290.html on Apr. 17, 2015.
Office Action issued in related U.S. Appl. No. 14/493,565, Apr. 7, 2015.
Office Action issued in related German Patent Application No. 102014224324.6, mailed Oct. 15, 2015.
Office Action issued in related German Patent Application No. 102014224325.4, mailed Oct. 15, 2015.
Office Action issued in related German Patent Application No. 102014224326.2, mailed Oct. 15, 2015.
U.S. Office Action (Notice of Allowance) mailed in related U.S. Appl. No. 14/493,565, Feb. 1, 2016.
English translation of previously submitted German patent application No. 76 07 100, cited in foreign communication on Oct. 15, 2015.
English translation of previously submitted German patent application No. 575 988, cited in foreign communication on Oct. 15, 2015.
English translation of previously submitted foreign communication issued in German patent 10 2014 224 325.4, mailed Oct. 15, 2015.
U.S. Office Action (Notice of Allowance) mailed in related U.S. Appl. 14/493,565, Dec. 10, 2015.
Office Action and Search Report issued in related Chinese patent application No. 201510043417.0, mailed Jul. 25, 2016.
Notice of First Action and Search Report issued in related Chinese patent application No. 2015100435953, mailed Aug. 29, 2016.

* cited by examiner

LIQUID CONSUMING APPARATUS

CROSS REFERENCE TO RELATED APPLICATION

The present application claims priority to and the benefit of European Patent Application No. 14180072.2, which was filed on Aug. 6, 2014, the disclosure of which is incorporated herein by reference in its entirety.

BACKGROUND OF THE INVENTION

1. Field of the Invention

The present invention relates to a liquid consuming apparatus.

2. Description of Related Art

A known ink-jet recording apparatus is configured to record an image on a recording medium by ejecting ink stored in an ink container from nozzles. The viscosity of ink stored in the ink container may change over time. A known ink-jet recording apparatus, as described in Patent Application Publication No. JP-09-277560 A, is configured to estimate the viscosity of ink stored in an ink container, and perform optimized preliminary ejection based on the result of the estimation. More specifically, the ink-jet recording apparatus is configured to estimate the viscosity of ink based on an elapsed time since the ink container is mounted to the ink-jet recording apparatus and an amount of ink remaining in the ink container. Nevertheless, this known ink-jet recording apparatus does not estimate the viscosity by directly measuring a physical quantity obtained when a movable member moves in ink. Moreover, this known ink-jet recording apparatus cannot estimate the viscosity of ink stored in an ink container which has not been mounted to the ink-jet recording apparatus and been unused.

SUMMARY OF THE INVENTION

Therefore, a need has arisen for a liquid consuming apparatus which overcomes these and other shortcomings of the related art. A technical advantage of the present invention is that the viscosity of liquid stored in a liquid container of a liquid consuming apparatus may be estimated by more direct measurement.

According to an aspect of the present invention, a liquid consuming apparatus comprises: a liquid container comprising: a liquid chamber configured to store liquid; a liquid supply opening configured to supply the liquid from the liquid chamber to an exterior of the liquid chamber; a movable member positioned in the liquid chamber and comprising a detection portion, wherein when the movable member moves, the detection portion moves in a moving path; and a restriction member configured to restrict movement of the movable member in the liquid chamber; a liquid consuming portion configured to consume liquid supplied from the liquid container via the liquid supply opening; a release member configured to release the movable member from restriction by the restriction member; a detector configured to output a detection signal based on presence or absence of the detection portion in a detection position in the moving path; and a controller configured to: measure, based on the detection signal output from the detector, a physical quantity, based on which a velocity of the detection portion moving in the moving path can be specified; and determine whether the physical quantity is within a threshold range.

With this configuration, because the movable member moves against viscous and inertial resistances caused by the liquid in the liquid container, the velocity of the detection portion depends on the viscosity of liquid in the liquid chamber. By measuring a physical quantity, based on which the velocity of the detection portion can be specified, the viscosity of liquid stored in the liquid container may be estimated.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention, and their features and advantages, may be understood by referring to FIGS. 1-20B, like numerals being used for like corresponding parts in the various drawings.

[Printer 10]

Figure 1:
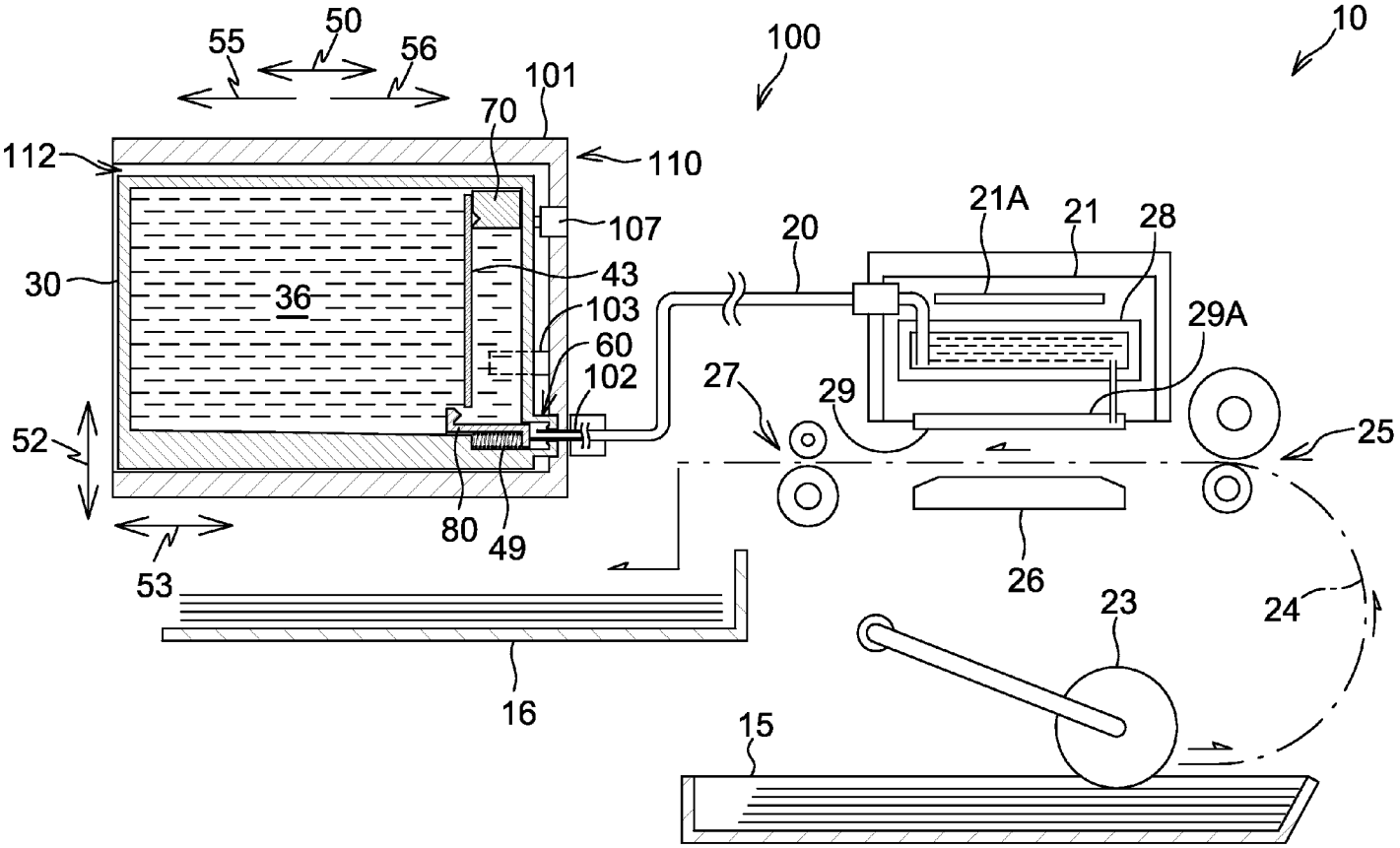
FIG. 1 is a schematic, cross-sectional view of a printer comprising a cartridge mounting portion and an ink cartridge, according to an embodiment of the present invention.

Referring to FIG. 1, a liquid consuming apparatus, such as an inkjet printer 10 is configured to record an image on a sheet of recording paper by ejecting ink droplets selectively on the sheet of recording paper. The printer 10 comprises a liquid consuming portion, e.g., a recording head 21, an ink supply device 100, and an ink tube 20 connecting the recording head 21 and the ink supply device 100. The ink supply device 100 comprises a cartridge mounting portion 110. The cartridge mounting portion 110 is configured to allow a liquid container or a liquid cartridge, e.g., an ink cartridge 30 to be mounted therein. The cartridge mounting portion 110 has an opening 112 and the interior of the cartridge mounting portion 110 is exposed to the exterior of the cartridge mounting portion 110 via opening 112. The ink cartridge 30 is configured to be inserted into the cartridge mounting portion 110 via the opening 112 in an insertion direction 56, and to be removed from the cartridge mounting portion 110 via the opening 112 in a removal direction 55.

The ink cartridge 30 is configured to store ink, which is used by the printer 10. The ink cartridge 30 and the recording head 21 are fluidically connected via the ink tube 20 when mounting of the ink cartridge 30 to the cartridge mounting portion 110 has been completed. The recording head 21 comprises a sub tank 28. The sub tank 28 is configured to temporarily store ink supplied via the ink tube 20 from the ink cartridge 30. The recording head 21 comprises nozzles 29 and is configured to selectively eject ink supplied from the sub tank 28 through the nozzles 29. More specifically, the recording head 21 comprises a head control board 21A and piezoelectric actuators 29A corresponding to the nozzles 29, and the head control board 21A is configured to selectively apply driving voltage to the piezoelectric actuators 29A. As such, ink is ejected from the nozzles 29.

The printer 10 comprises a paper feed tray 15, a paper feed roller 23, a conveying roller pair 25, a platen 26, a discharge roller pair 27, and a discharge tray 16. A conveying path 24 is formed from the paper feed tray 15 up to the discharge tray 16 via the conveying roller pair 25, the platen 26, and the discharge roller pair 27. The paper feed roller 23 is configured to feed a sheet of recording paper from the paper feed tray 15 to the conveying path 24. The conveying roller pair 25 is configured to convey the sheet of recording paper fed from the paper feed tray 15 onto the platen 26. The recording head 21 is configured to selectively eject ink onto the sheet of recording paper passing over the platen 26. Accordingly, an image is recorded on the sheet of recording paper. The sheet of recording paper having passed over the platen 26 is discharged by the discharge roller pair 27 to the paper discharge tray 16 disposed at the most downstream side of the conveying path 24.

[Ink Supply Device 100]

Figure 2:
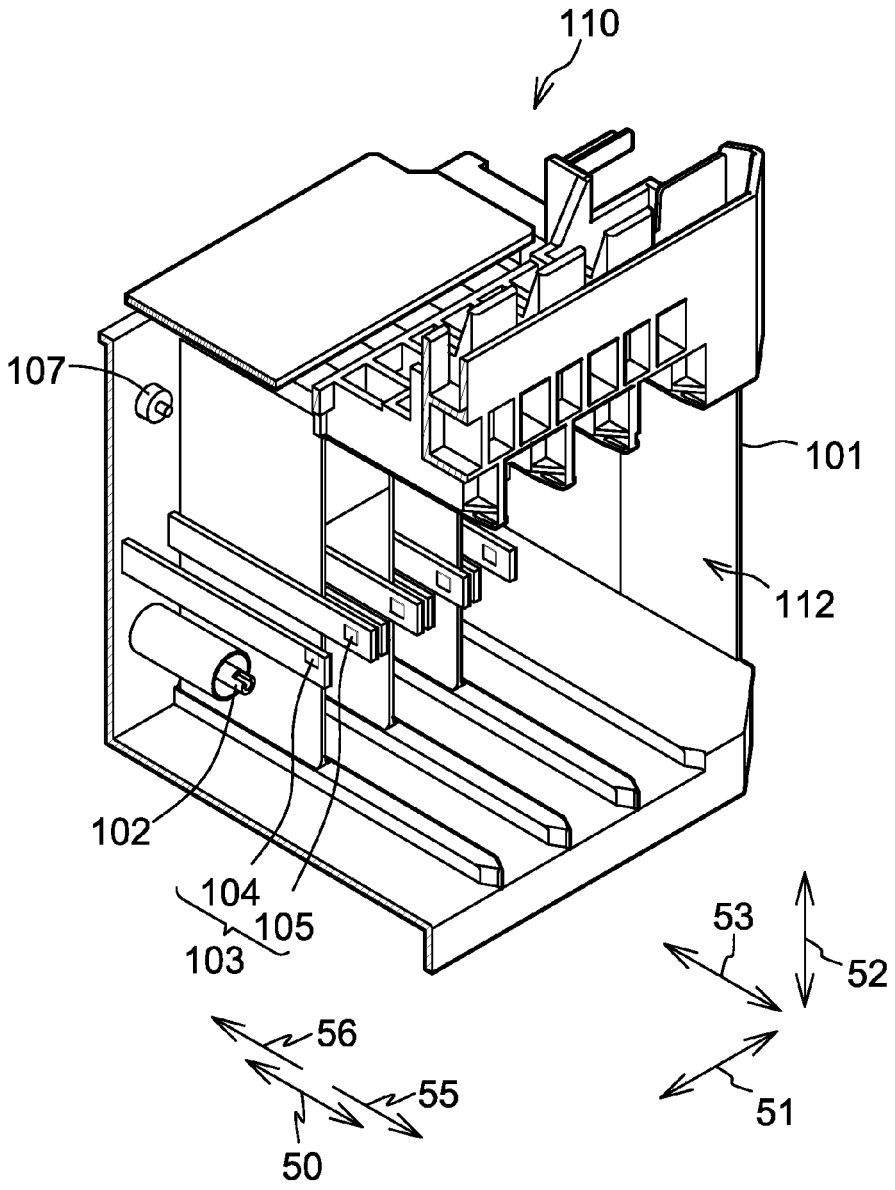
FIG. 2 is a perspective view of the cartridge mounting portion which is partly cut, showing an end surface of the cartridge mounting portion.

Referring to FIG. 1, the printer 10 comprises the ink supply device 100. The ink supply device 100 is configured to supply ink to the recording head 21. The ink supply device 100 comprises the cartridge mounting portion 110 to which the ink cartridge 30 is mountable. The cartridge mounting portion 110 comprises a case 101, a longitudinal object, e.g., a hollow tube 102, a detector, e.g., a sensor 103, and a mount detector, e.g., a mount sensor 107. In FIG. 1, mounting of the ink cartridge 30 to the cartridge mounting portion 110 has been completed. Referring to FIG. 2, the illustrated example of the cartridge mounting portion 110 is configured to receive four ink cartridges 30 storing various ink colors, such as cyan, magenta, yellow, and black inks, respectively. Four hollow tubes 102, four sensors 103, and four mount sensors 107 are provided at the cartridge mounting portion 110, corresponding to the four ink cartridges 30.

The case 101 of the cartridge mounting portion 110 has the opening 112 formed through one face of the case 101. The case 101 comprises an end surface opposite the opening 112. Referring to FIGS. 1 and 2, the hollow tube 102 extends from the end surface of the case 101 in the removal direction 55. The hollow tube 102 is positioned at the end surface of the case 101 and at a position corresponding to an ink supply portion 60 (described later) of the ink cartridge 30. The hollow tube 102 is a resin tube having a liquid path formed therein. The hollow tube 102 has a proximal end and a distal end. The hollow tube 102 has an opening formed through a distal-end side of the hollow tube 102, and the ink tube 20 is connected to a proximal-end side of the hollow tube 102. When the hollow tube 102 is inserted into the ink supply portion 60 of the ink cartridge 30, ink stored in the ink cartridge 30 is allowed to flow into the ink tube 20 via the hollow tube 102.

The printer 10 comprises a cover (not shown) configured to selectively cover the opening 112 of the cartridge mounting portion 110 and not cover the opening 112 such that the opening 112 is exposed to the exterior of the printer 10. The cover is supported by the case 101 or by an outer case of the printer 10 such that the cover can be selectively opened and closed. When the cover is opened, the opening 112 is exposed to the exterior of the printer 10. When the cover is opened, a user can insert the ink cartridge 30 into the cartridge mounting portion 110 through the opening 112 and can remove the ink cartridge 30 from the cartridge mounting portion 110 through the opening 112. When the cover is closed, the opening 112 is covered and the ink cartridge 30 cannot be inserted into or removed from the cartridge mounting portion 110.

In this description, when it is described that the ink cartridge 30 is mounted to the cartridge mounting portion 110, it means that at least a portion of the ink cartridge 30 is positioned in the cartridge mounting portion 110, more specifically, positioned in the case 101. Therefore, an ink cartridge 30 which is being inserted into the cartridge mounting portion 110 is also an example of an ink cartridge 30 mounted to the cartridge mounting portion 110. On the other hand, when it is described that the mounting of the ink cartridge 30 to the cartridge mounting portion 110 has been completed, it means that the ink cartridge 30 is in such a state that the printer 10 can perform image recording. For instance, when the ink cartridge 30 is in such a state, ink supply from the ink cartridge 30 to the recording head 21 is at least possible, and preferably the ink cartridge 30 is locked such that the movement of ink cartridge 30 relative to the cartridge mounting portion 110 is restricted or the ink cartridge 30 is positioned in the cartridge mounting portion 110 with the cover closed.

[Sensor 103]

Referring to FIG. 2, the sensor 103 is positioned above the hollow tube 102 and extends from the end surface of the case 101 in the removal direction 55. The sensor 103 comprises a light emitting portion, e.g., a light emitting diode, 104 and a light receiving portion, e.g., a phototransistor, 105 aligned in a width direction 51. The light emitting portion 104 and the light receiving portion 105 face each other in the width direction 51. The light emitting portion 104 is configured to emit light, e.g., visible, infrared, and/or ultraviolet light, toward the light receiving portion 105, and the light receiving portion 105 is configured to receive the light emitted by the light emitting portion 104. The light emitted by the light emitting portion 104 can pass through ink stored in the ink cartridge 30. When the mounting of the ink cartridge 30 to the cartridge mounting portion 110 has been completed, the ink cartridge 30 is positioned between the light emitting portion 104 and the light receiving portion 105. In other words, the light emitting portion 104 and the light receiving portion 105 are provided so as to face each other with the ink cartridge 30 positioned therebetween when the mounting of the ink cartridge 30 to the cartridge mounting portion 110 has been completed.

A detection position is a position within the ink cartridge 30 which intersects an imaginary line extending between the light emitting portion 104 and the light receiving portion 105 when the mounting of the ink cartridge 30 to the cartridge mounting portion 100 has been completed. In other words, the detection position intersects an optical path extending between the light emitting portion 104 and the light receiving portion 105. In other words, the sensor 103 is positioned so as to face the detection position. In this embodiment, the sensor 103 is positioned so as to face the ink cartridge 30 when the mounting of the ink cartridge 30 to the cartridge mounting portion 110 has been completed. In another embodiment, the sensor 103 is positioned so as to face the ink cartridge 30 when the ink cartridge 30 is being inserted into the cartridge mounting portion 110. That is, the sensor 103 is positioned so as to face the ink cartridge 30 mounted to the cartridge mounting portion 110, and the detection position intersects the optical path extending between the light emitting portion 104 and the light receiving portion 105 when the ink cartridge 30 is mounted to the cartridge mounting portion 110.

The sensor 103 is configured to output different detection signals based on the intensity of light received by the light receiving portion 105. The sensor 103 is configured to output a Low-level signal, i.e., a signal whose level is less than a predetermined threshold value, when the intensity of light received by the light receiving portion 105 is less than a predetermined intensity. The sensor 103 is configured to output a High-level signal, i.e., a signal whose level is greater than or equal to the predetermined threshold value, when the intensity of light received by the light receiving portion 105 is greater than or equal to the predetermined intensity.

[Mount Sensor 107]

Referring to FIGS. 1 and 2, the mount sensor 107 is positioned in a mount detection position in an insertion path of the ink cartridge 30 in the cartridge mounting portion 110. The ink cartridge 30 moves in the insertion path when the ink cartridge 30 is inserted into the cartridge mounting portion 110. In this embodiment, the mount sensor 107 is positioned at the end surface of the case 101. The mount sensor 107 is configured to output different detection signals based on the presence or absence of the ink cartridge 30 in the mount detection position. In this embodiment, the mount sensor 107 is positioned, such that the ink cartridge 30 is positioned in the mount detection position when the mounting of the ink cartridge 30 to the cartridge mounting portion 100 has been completed. In this embodiment, the mount sensor 107 is a mechanical sensor configured to output a signal indicating that the ink cartridge 30 is mounted to the cartridge mounting portion 100 when the mechanical sensor is pushed by a front wall 40 (described later) of the ink cartridge 30. Nevertheless, the mount sensor 107 is not limited to the mechanical sensor, but may be an optical sensor such as a combination of a light emitting diode and a phototransistor, a magnetic sensor such as a Hall effect sensor, an electric sensor, or any other known sensor.

[Ink Cartridge 30]

Figure 3A:
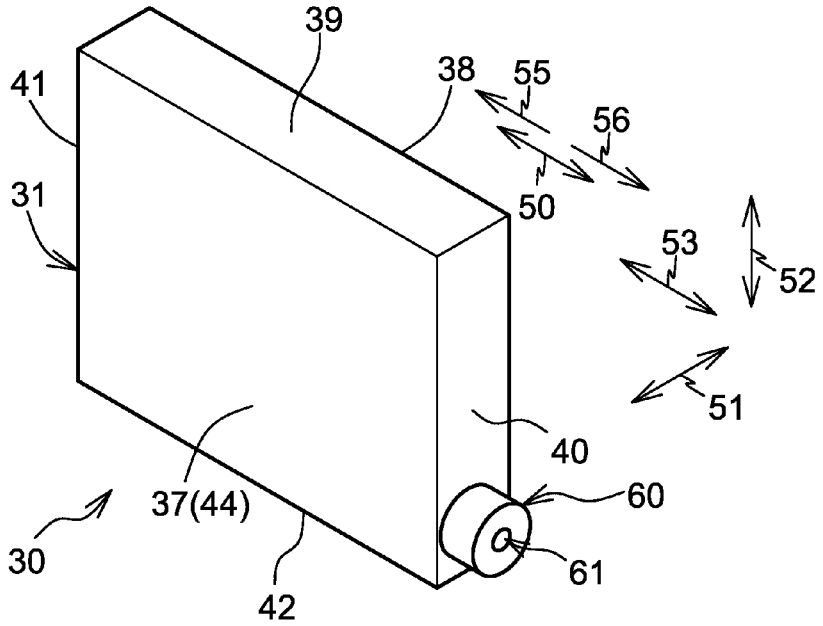
FIG. 3A is a perspective view of the ink cartridge, in which a film is welded to a frame.
Figure 3B:
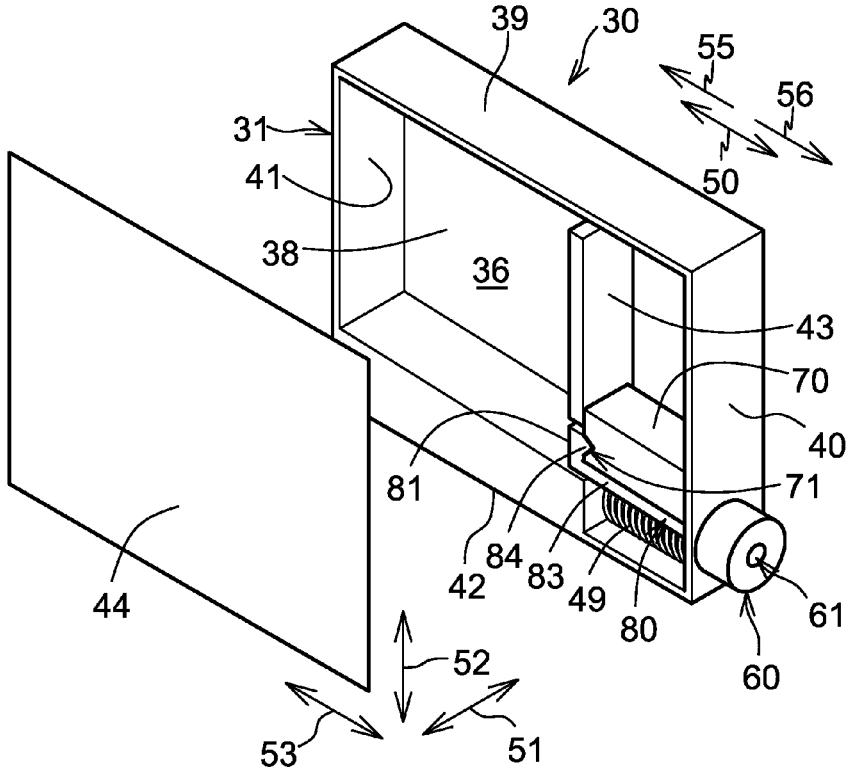
FIG. 3B is an exploded perspective view of the ink cartridge, in which the film is removed from the frame.

Referring to FIGS. 3A and 3B, the ink cartridge 30 comprises a frame 31 having a liquid chamber, e.g., an ink chamber 36 formed therein, and a liquid supply portion, e.g., an ink supply portion 60 extending from the frame 31. The ink cartridge 30 is configured to supply ink stored in the ink chamber 36 to the exterior of the ink cartridge 30 via the ink supply portion 60. The ink cartridge 30 is configured to be inserted into and removed from the cartridge mounting portion 110 in an insertion-removal direction 50, while the ink cartridge 30 is in an upright position, as shown in FIG. 3A, with a top face of the ink cartridge 30 facing upward and a bottom face of the ink cartridge 30 facing downward. In this embodiment, the insertion-removal direction 50 extends in a horizontal direction. The insertion direction 56 is an example of the insertion-removal direction 50. The removal direction 55 is an example of the insertion-removal direction 50. The insertion direction 56 and the removal direction 55 are opposite directions. In another embodiment, the insertion-removal direction 50 may not extend exactly in a horizontal direction but may extend in a direction intersecting a horizontal direction and the vertical direction.

The frame 31 has substantially a rectangular parallelepiped shape, and its dimension in a width direction (left-right direction) 51 is less than each of its dimension in a height direction (up-down direction) 52 and its dimension in a depth direction (front-rear direction) 53. The width direction 51, the height direction 52, and the depth direction 53 are perpendicular to each other. The width direction 51 extends in a horizontal direction. The depth direction 53 extends in a horizontal direction. The height direction 52 extends in the vertical direction. The insertion-removal direction 50 is parallel with the depth direction 53. The frame 31 comprises a front wall 40, a rear wall 41, a top wall 39, a bottom wall 42, and a right wall 38. The front wall 40 and the rear wall 41 at least partly overlap when viewed in the depth direction 53. The top wall 39 and the bottom wall 42 at least partly overlap when viewed in the height direction 52. The right wall 38 is positioned on one side of the frame 31 with respect to the width direction 51. In this embodiment, the right wall 38 is positioned on the right side of the frame 31 when the frame 31 is viewed from the front-wall 40 side. When the ink cartridge 30 is inserted into the cartridge mounting portion 110, the front wall 40 is positioned at the front side of the ink cartridge 30, and the rear wall 41 is positioned at the rear side of the ink cartridge 30. When the ink cartridge 30 is inserted into the cartridge mounting portion 110, the front wall 40 is oriented toward the insertion direction 56, and the rear wall 41 is oriented toward the removal direction 55. The rear wall 41 is positioned away from the front wall 40 in the removal direction 55. The frame 31 comprises a front outer face, a rear outer face, a top outer face, a bottom outer face, and a right outer face. The front wall 40 comprises the front outer face, the rear wall 41 comprises the rear outer face, the top wall 39 comprises the top outer face, the bottom wall 42 comprises the bottom outer face, and the right wall 38 comprises the right outer face.

The top wall 39 is connected to the upper end of the front wall 40, the upper end of the rear wall 41, and the upper end of the right wall 38. The bottom wall 42 is connected to the lower end of the front wall 40, the lower end of the rear wall 41, and the lower end of the right wall 38. The right wall 38 is connected to the right end of the front wall 40, the right end of the rear wall 41, the right end of the top wall 39, and the right end of the bottom wall 42. The other side of the frame 31 with respect to the width direction 51 is opened. In this embodiment, the left side of the frame 31, which is positioned on the left side of the frame 32 when the frame 31 is viewed from the front-wall 40 side, is opened. The frame 31 comprises a partitioning wall 43 extending from the inner surface of the right wall 38 in the width direction 51 toward the left side of the frame 31. The partitioning wall 43 extends in the height direction 52. The partitioning wall 43 is positioned away from the front wall 40. The partitioning wall 43 extends substantially in parallel with the front wall 40. Each wall of the frame 31 allows the light emitted from the light emitting portion 104 of the sensor 103 to pass therethrough.

The ink cartridge 30 comprises a left wall 37 connected to the left side of the frame 31 with respect to the width direction 51. In this embodiment, the left wall 37 is a film 44. The film 44 and the frame 31 have almost the same outer contour when viewed in the width direction 51. The film 44 is welded to the left end of the front wall 40, the left end of the rear wall 41, the left end of the top wall 39, the left end of the bottom wall 42, and the left end of the partitioning wall 43 by heat. As such, it is possible to store ink in the ink chamber 36 defined by the front wall 40, the rear wall 41, the top wall 39, the bottom wall 42, the right wall 38, and the left wall 37 (the film 44). The left wall 37 (the film 44) allows the light emitted from the light emitting portion 104 of the sensor 103 to pass therethrough. The ink cartridge 30 may comprise a cover covering the film 44 from outside. In such a case, the cover also allows the light emitted from the light emitting portion 104 of the sensor 103 to pass therethrough.

Referring to FIGS. 1, 3A and 3B, the ink supply portion 60 extends from the front outer face of the front wall 40 in the insertion direction 56. In this embodiment, the ink supply portion 60 has a cylindrical shape. The ink supply portion 60 has a proximal end at the front wall 40 and a distal end opposite the proximal end. The ink supply portion 60 has a liquid supply opening, e.g., an ink supply opening 61 formed at the distal end. The ink supply portion 60 has an inner space and the inner space can be in fluid communication with the exterior of the ink cartridge 30 via the ink supply opening 61. The inner space of the ink supply portion 60 is in fluid communication with the inner space of the frame 31, i.e., the ink chamber 36, at the proximal-end side. The ink chamber 36 can be in fluid communication with the exterior of the ink cartridge 30 via the ink supply portion 60. Before the ink cartridge 30 is mounted to the cartridge mounting portion 110, the ink supply opening 61 is closed by an operation portion 82 (described later). In this description, when it is described that the ink supply opening 61 is provided at the front wall 40, it at least means that the ink supply opening 61 penetrates through the front wall 40, or that the ink supply opening 61 is provided at the distal end of the ink supply portion 60 extending from the front wall 40 in the insertion direction 56, or that the ink supply opening 61 is provided at a distal end of an protrusion extending from the front wall 40 in the removal direction 55.

The ink cartridge 30 further comprises a movable member 70, a restriction member 80, and a biasing member, e.g., a coil spring 49 in the frame 31, i.e., in the ink chamber 36. The ink cartridge 30 also has an air introduction portion (not shown) for introducing air into the ink chamber 36.

[Movable Member 70]

The movable member 70 comprises a detection portion and a float. In this description, when it is described that a movable member comprises a detection portion and a float it at least means that the movable member comprises the detection portion and the float as portions of the movable member, or that the movable member comprises the detection portion and the float as the entirety of the movable member. In this embodiment, the movable member 70, the detection portion, and the float are one and the same member. The movable member (float, detection portion) 70 has a specific gravity which is less than the specific gravity of ink stored in the ink chamber 36. When the movable member (float, detection portion) 70 is released from a restriction portion 81 (described later), the movable member (float, detection portion) 70 moves upward due to the buoyancy acting on the movable member (float, detection portion) 70 in a free range within the ink chamber 36. More specifically, the movable member (float, detection portion) 70 is configured to move in a space defined by the right wall 38, the front wall 40, the partitioning wall 43, and the film 44. The partitioning wall 42 is an example of a guide wall configured to guide the movement of the movable member (float, detection portion) 70. The space is an example of a moving path and an example of the free range. The above-described detection position is in the moving path and in the free range. The movable member (float, detection portion) 70 comprises a recessed portion 71 at its wall surface facing the removal direction 55. In the example illustrated, the movable member 70 is generally a rectangular parallelepiped shape, though other suitable shapes for the movable member 70 are possible.

The movable member (float, detection portion) 70 comprises a light blocking portion. In this embodiment, the movable member (float, detection portion) 70 comprises the light blocking portion as its entirety. That is, the movable member 70, the detection portion, the float, and the light blocking portion are one and the same member. The movable member (float, detection portion, light blocking portion) 70 is configured to block the light emitted by the light emitting portion 104 of the sensor 103. More specifically, when the movable member (float, detection portion, light blocking portion) 70 is in the detection position and the light emitted by the light emitting portion 104 of the sensor 103 reaches one side of the movable member (float, detection portion, light blocking portion) 70 in a direction (the width direction 51) perpendicular to the insertion-removal direction 50, an amount (intensity) of light coming out of the other side of the movable member (float, detection portion, light blocking portion) 70 and reaching the light receiving portion 105 of the sensor 103 is less than a predetermined amount (intensity), e.g., zero. The blocking of the light is caused by the movable member (float, detection portion, light blocking portion) 70 completely preventing the light from passing therethrough in width direction 51 perpendicular to the insertion-removal direction 50, by the movable member (float, detection portion, light blocking portion) 70 absorbing some amount of the light, by the movable member (float, detection portion, light blocking portion) 70 deflecting the light, by the movable member (float, detection portion, light blocking portion) 70 totally reflecting the light, or by another phenomenon. For instance, the movable member (float, detection portion, light blocking portion) 70 is made of an opaque resin containing pigment, or made of a transparent or semi-transparent resin, but has a prism-like shape configured to deflect light, or comprises a reflection film, e.g., an aluminum film on its surface. On the other hand, when the movable member (float, detection portion, light blocking portion) 70 is not in the detection position and the light emitted by the light emitting portion 104 of the sensor 103 reaches one side of the ink cartridge 30 in the width direction 51 perpendicular to the insertion-removal direction 50, an amount (intensity) of light coming out of the other side of the ink cartridge 30 and reaching the light receiving portion 105 of the sensor 103 is greater than or equal to the predetermined amount (intensity). As such, the amount (intensity) of the light reaching the light receiving portion 105 of the sensor 103 depends on whether the movable member (float, detection portion, light blocking portion) 70 is in the detection position or not.

[Restriction Member 80]

Referring to FIGS. 3A, 3B, and 5A to 5C, the restriction member 80 comprises a restriction portion 81, an operation portion 82, and a connection portion 83 connected to the restriction portion 81 and the operation portion 82.

Figure 5A:
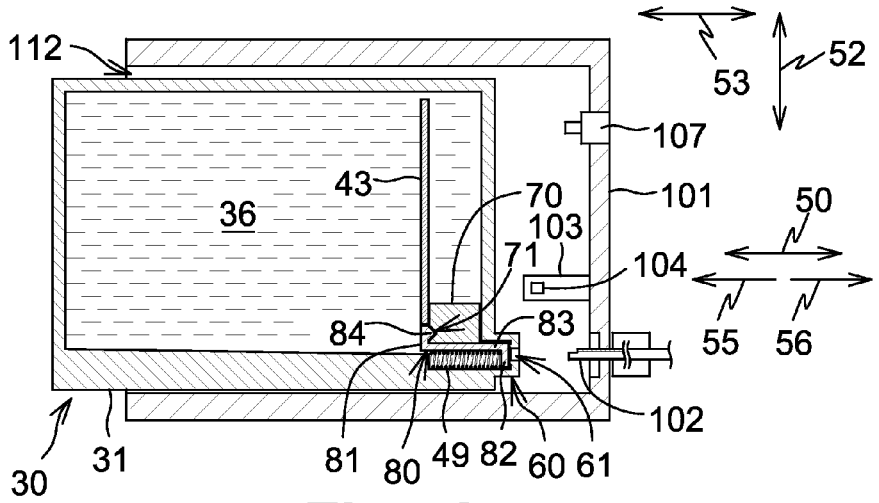
FIG. 5A is a cross-sectional view of the ink cartridge and the cartridge mounting portion during insertion of the ink cartridge into the cartridge mounting portion.
Figure 5B:
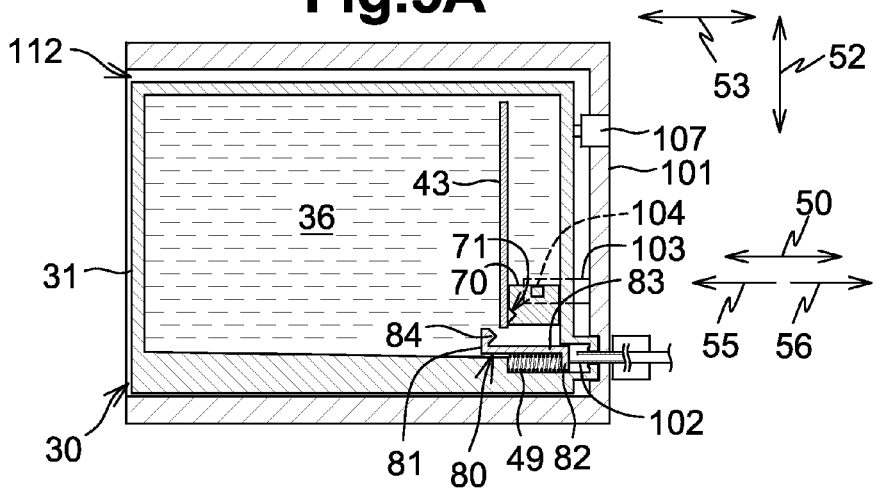
FIG. 5B is a cross-sectional view of the ink cartridge and the cartridge mounting portion when mounting of the ink cartridge to the cartridge mounting portion has been completed and the upper end of a movable member is in a detection position.

In the illustrated example the operation portion 82 extends downward from a front end of the connection portion 83 which extends in the depth direction 53. The operation portion 82 comprises a front surface facing in the insertion direction 56, and the front surface of the operation portion 82 faces the ink supply opening 61 of the ink supply portion 60 in the depth direction 53. The operation portion 82 is movable between a first position as shown in FIG. 5A and a second position as shown in FIG. 5B. The second position is closer to the rear outer face of the rear wall 41 than the first position is. When the operation portion 82 is in the first position, the operation portion 82 contacts a wall surrounding the ink supply opening 61 and thereby closes the ink supply opening 61. When the operation portion 82 is in the second position, the operation portion 82 is positioned away from the wall surrounding the ink supply opening 61 and thereby opens the ink supply opening 61 and establishes a fluid flow path from the ink chamber 36 through the ink supply opening 61. The operation portion 82 is operable from the exterior of the ink cartridge 30. In this embodiment, the operation portion 82 is operable by the hollow tube 102 via the ink supply opening 61. When the ink cartridge 30 is mounted to the cartridge mounting portion 110, hollow tube 102 is inserted into the ink supply portion 60 through the ink supply opening 61, and the hollow tube 102 pushes the operation portion 82 from the first position to the second position in the removal direction 55.

The restriction portion 81 extends upward from a rear end of the connection portion 83. The restriction portion 81 comprises a front surface facing in the insertion direction 56 and a protrusion 84 extending from the front surface in the insertion direction 56. When the operation portion 82 is in the first position, the protrusion 84 engages with the recessed portion 71 of the movable member (float, detection portion, light blocking portion) 70, such that the movement of the movable member (float, detection portion, light blocking portion) 70 is restricted within a restricted range. The movable member (float, detection portion, light blocking portion) 70 may be made completely immovable by the restriction portion 81. In such a case, the restricted range is zero. The movable member (float, detection portion, light blocking portion) 70 may slightly move within the restricted range to the extent that the dimensional errors of the protrusion 84 and the recessed portion 71 allow. The movable member (float, detection portion, light blocking portion) 70 may move within the restricted range as long as movable member (float, detection portion, light blocking portion) 70 does not reach the detection position. When the movable member (float, detection portion, light blocking portion) 70 is in the restricted range, the movable member (float, detection portion, light blocking portion) 70 is submerged in ink.

When the operation portion 82 is in the second position, the protrusion 84 is positioned away from the recessed portion 71 and thereby the restriction portion 81 disengages and releases the movable member (float, detection portion, light blocking portion) 70, such that the movable member (float, detection portion, light blocking portion) 70 is positioned in the free range which is above the restricted range. In another embodiment, when the operation portion 82 is in the second position, the restriction portion 81 may not be completely positioned away from the movable member (float, detection portion, light blocking portion) 70, but may still contact the movable member (float, detection portion, light blocking portion) 70 as long as the movable member (float, detection portion, light blocking portion) 70 is released and can move in the free range.

The coil spring 49 has a first end contacting a surface of the frame 31 facing in the insertion direction 56 in the ink chamber 36 and a second end contacting a rear surface of the operation portion 82 facing in the removal direction 55. The coil spring 49 is configured to bias the operation portion 82 in the insertion direction 56 into the first position. The coil spring 49 is an example of a biasing member and can be replaced with a leaf spring, resin spring, etc.

[Controller 130]

Figure 4:
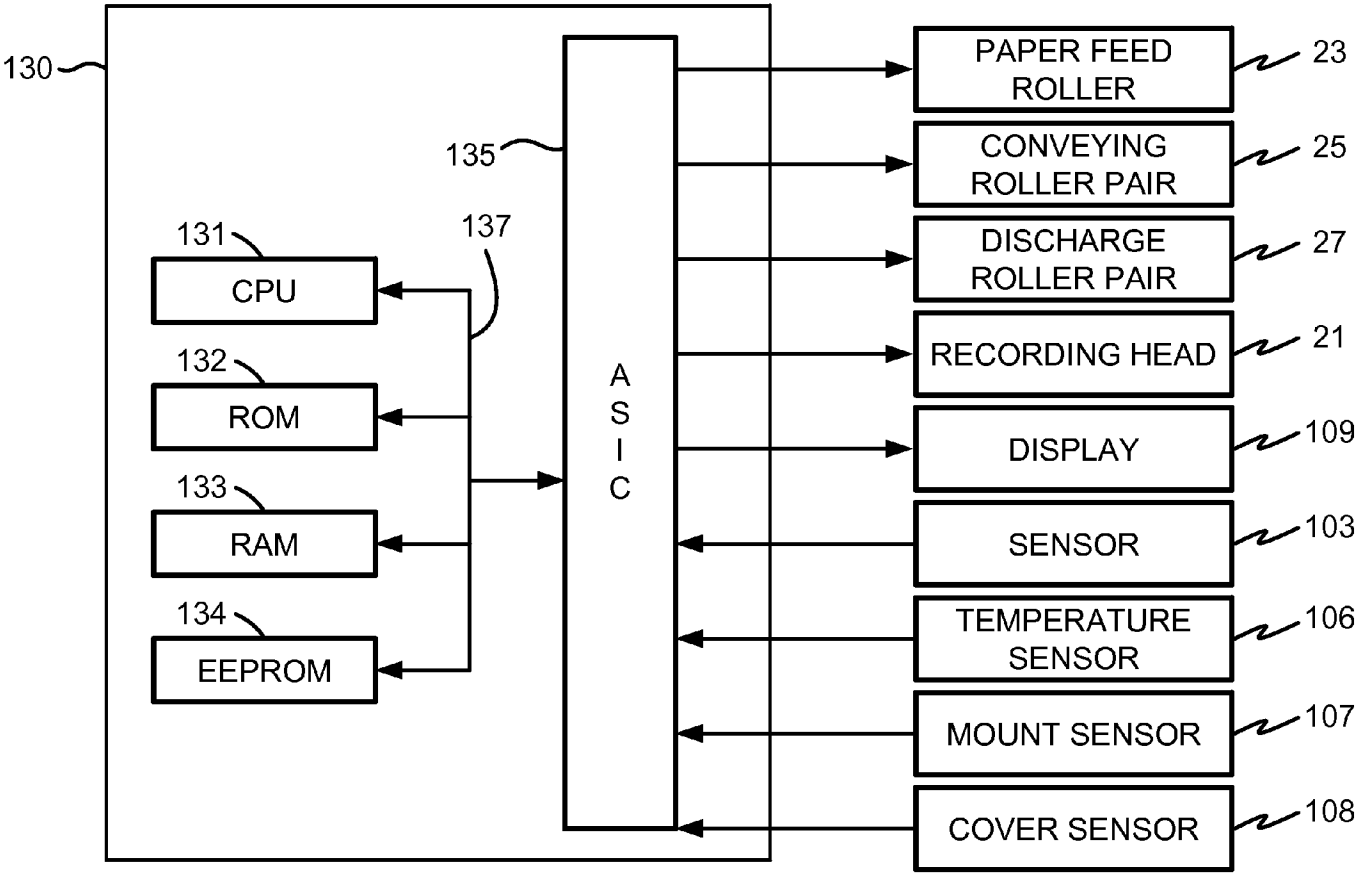
FIG. 4 is a functional block diagram of the printer.

Referring to FIG. 4, the printer 10 comprises a controller 130. The controller 130 comprises a CPU 131, a ROM 132, a RAM 133, an EEPROM 134, and an ASIC 135, which are connected to each other by an internal bus 137. The ROM 132 stores programs for the CPU 131 to control various operations of the printer 10. The RAM 133 is used as a storage area for temporarily store date and signals for the CPU 131 to use in executing the programs and as a working area for date processing. The EEPROM 134 stores settings and flags which may be retained even after the power is off. One chip may comprise the CPU 131, the ROM 132, the RAM 133, the EEPROM 134, and the ASIC 135, or one chip may comprise some of the CPU 131, the ROM 132, the RAM 133, the EEPROM 134, and the ASIC 135 and another chip may comprise the other of the CPU 131, the ROM 132, the RAM 133, the EEPROM 134, and the ASIC 135.

The controller 130 is configured to rotate the paper feed roller 23, the conveying roller pair 25, and the discharge roller pair 27 by driving a motor (not shown). The controller 130 is configured to control the recording head 21 to eject ink from the nozzles 29. More specifically, the controller 130 is configured to send to the head control board 21A control signals indicating the values of driving voltages to be applied to the piezoelectric actuators 29A. The head control board 21A is configured to apply the driving voltages to the piezoelectric actuators 29A based on the control signals received from the controller 130, such that ink is ejected from the nozzles 29. The printer 10 also comprises a display 109, and the controller 130 is configured to control the display 109 to display information about the printer 10 and the ink cartridge 30 or a variety of messages.

The printer 10 also comprises a temperature sensor 106 and a cover sensor 108, and the controller 130 is configured to receive the detection signals output from the sensor 103, signals output from the temperature sensor 106, the detection signals output from the mount sensor 107, and signals output from the cover sensor 108. The temperature sensor 106 is configured to output signals based on temperature. Where the temperature sensor 106 senses temperature is not limited to a specific position. The temperature sensor 103 may be positioned in the cartridge mounting portion 110, or may be positioned on an outer surface of the printer 10. The cover sensor 108 is configured to output different signals based on whether the cover for the opening 112 of the cartridge mounting portion 110 is opened or closed.

The ink cartridge 30 is inserted into the cartridge mounting portion 110 when the cover of the cartridge mounting portion 110 is opened. Referring to FIG. 5A, when the ink cartridge 30 is being inserted into the cartridge mounting portion 110, the operation portion 82 is in the first position. Therefore, the movement of the movable member (float, detection portion, light blocking portion) 70 is restricted by the restriction portion 81, and the ink supply opening 61 of the ink supply portion 60 is closed by the operation portion 82. The sensor 103 outputs the High-level signal to the controller 130.

Referring to FIG. 5B, when the ink cartridge 30 is further inserted into the cartridge mounting portion 110, the hollow tube 102 is inserted into the ink supply portion 60 through the ink supply opening 61 and pushes the operation portion 82 in the removal direction 55 against the biasing force of the coil spring 49, such that the operation portion 82 moves from the first position to the second position. As a result, the movable member (float, detection portion, light blocking portion) 70 is released and the ink supply opening 61 is opened. When the mounting of the ink cartridge 30 to the cartridge mounting portion 110 is completed, the front wall 40 of the ink cartridge 30 pushes the mount sensor 107. When this occurs, the mount sensor 107 outputs a detection signal indicating the presence of the ink cartridge 30 in the mount detection position. The ink cartridge 30 may be locked by a lock mechanism (not shown) in the cartridge mounting portion 110 so as not to move in the removal direction 55 when the mounting of the ink cartridge 30 to the cartridge mounting portion 110 has been completed.

Figure 5C:
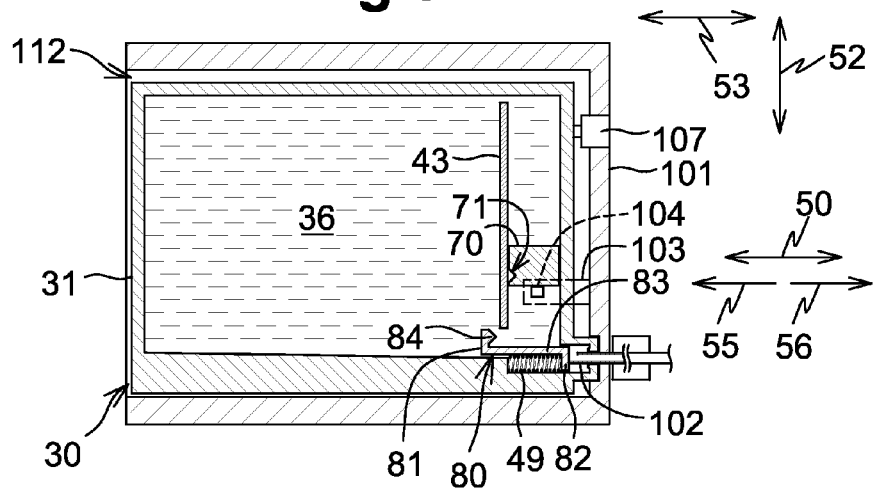
FIG. 5C is a cross-sectional view of the ink cartridge and the cartridge mounting portion when mounting of the ink cartridge to the cartridge mounting portion has been completed and the lower end of the movable member is in the detection position.
Figure 6A:
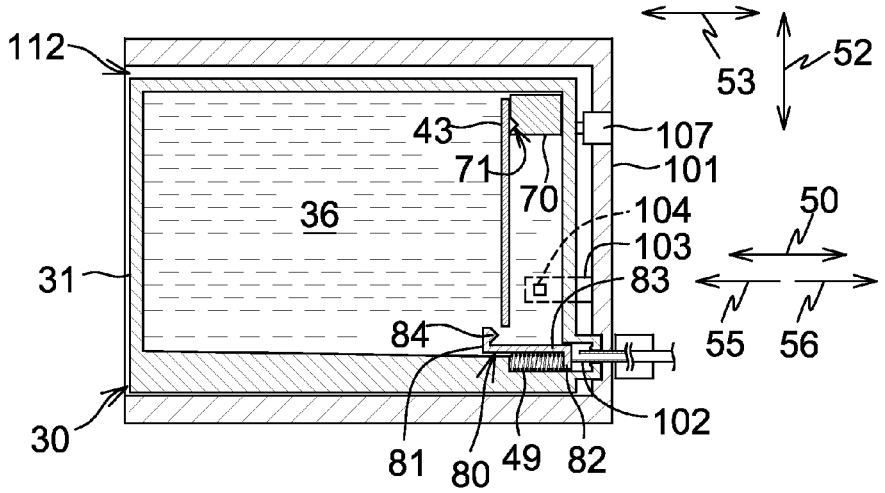
FIG. 6A is a cross-sectional view of the ink cartridge and the cartridge mounting portion when the movable member is at the upper end of a moving path.

The movable member (float, detection portion, light blocking portion) 70 released from the restriction portion 81 moves upward in the moving path or the free range between the front wall 40 and the portioning wall 43. When the upper end of the movable member (float, detection portion, light blocking portion) 70 reaches the detection position as shown in FIG. 5B, the detection signal output from the sensor 103 changes from the High-level signal to the Low-level signal. Subsequently, referring to FIG. 5C, the movable member (float, detection portion, light blocking portion) 70 moves further upward. When the lower end of the movable member (float, detection portion, light blocking portion) 70 passes the detection position, the detection signal output from the sensor 103 changes from the Low-level signal to the High-level signal. Referring to FIG. 6A, the movable member (float, detection portion, light blocking portion) 70 stops movement when the movable member (float, detection portion, light blocking portion) 70 contacts a surface defining the ink chamber 36, e.g., the inner surface of the top wall 39. Alternatively, the movable member (float, detection portion, light blocking portion) 70 stops movement when a portion of the movable member (float, detection portion, light blocking portion) 70 breaks the surface of ink and is exposed from the surface of ink.

When a user thinks that the mounting of the ink cartridge 30 to the cartridge mounting portion 110 has been completed, the user closes the cover of the cartridge mounting portion 110 to cover the opening 112. Even if the mounting of the ink cartridge 30 to the cartridge mounting portion 110 has not been completed, the closed cover contacts and pushes the ink cartridge 30 in the insertion direction 56 to complete the mounting of the ink cartridge 30 to the cartridge mounting portion 110.

[Processes Performed by the Controller 130]

Figure 7:
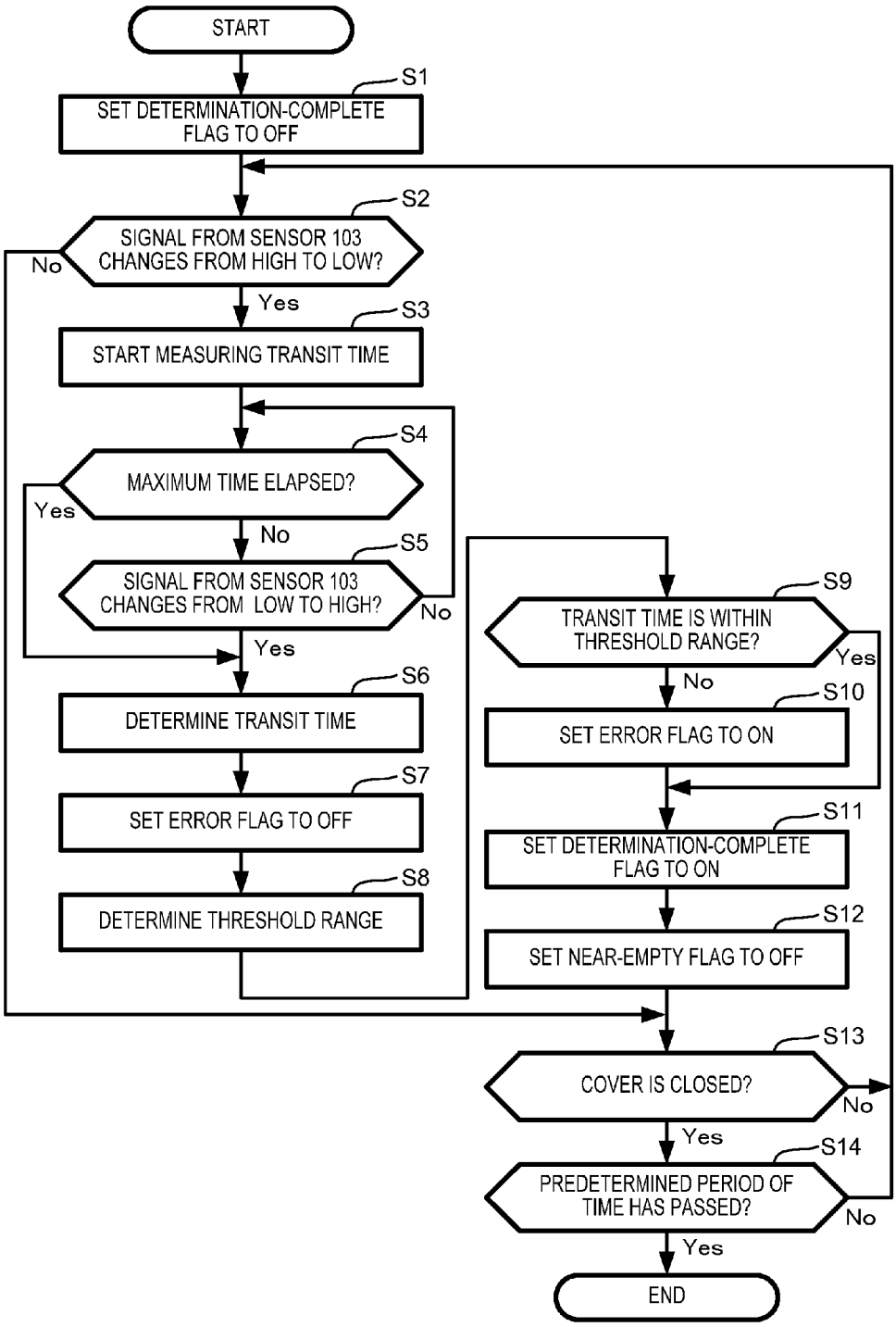
FIG. 7 is a flow chart of processes performed by a controller when a cover of the cartridge mounting portion is opened and a sensor outputs a High-level signal.

The controller 130 is configured to perform the processes of FIG. 7 when the controller 130 receives the signal from the cover sensor 108 indicating that the cover of the cartridge mounting portion 110 is opened and receives the High-level signal from the sensor 103. In other words, the processes of FIG. 7 start when the cover of the cartridge mounting portion 110 is opened to remove the ink cartridge 30 in an empty state.

The controller 130 resets a determination-complete flag, i.e., sets the determination complete flag to "OFF" at step S1. The determination-complete flag indicates whether determination of a transit time (described later at step S9) has been made. The determination-complete flag is set to "ON" when the determination of the transit time has been made, and is set to "OFF" when the determination of the transit time has not been made. The determination-complete flag is set for each ink cartridge 30. The controller 130 stores the determination-complete flag in the EEPROM 134.

Subsequently, the controller 130 starts measuring the transit time at step S3 if the detection signal output from the sensor 103 changes from the High-level signal to the Low-level signal (step S2: Yes). If the detection signal output from the sensor 103 does not change from the High-level signal to the Low-level signal (step S2: No), the controller 130 performs the process of step S13 (described later). For instance, the situation in which the detection signal output from the sensor 103 does not change from the High-level signal to the Low-level signal (step S2: No) corresponds to a situation in which a new ink cartridge 30 has not been mounted to the cartridge mounting portion 110.

Subsequently, the controller 130 determines whether the elapsed time since the controller 130 starts measuring the transit time has exceeded a predetermined maximum time at step S4. If the elapsed time has exceeded the maximum time (step S4: Yes), the controller 130 performs the process of step S6 (described later). If the elapsed time has not exceeded the maximum time (step S4: No), the controller 130 determines whether the detection signal output from the sensor 103 changes from the Low-level signal to the High-level signal at step S5. If the detection signal output from the sensor 103 does not change from the Low-level signal to the High-level signal (step S5: No), the controller 103 performs the process of step S4 again. If the detection signal output from the sensor 103 changes from the Low-level signal to the High-level signal (step S5: Yes), the controller 103 determines the transit time. The transit time is a period of time from when the detection signal output from the sensor 103 changes from the High-level signal to the Low-level signal (step S2: Yes) to when the detection signal output from the sensor 103 changes from the Low-level signal to the High-level signal (step S5: Yes).

In other words, the controller 130 measures the transit time from when the Low-level signal as an example of a first detection signal is output to when the High-level signal as an example of a second detection signal is output. Thus, the controller 130 measures the duration time during which the sensor 103 outputs the Low-level signal. The controller 130 measures the time required for the movable member (float, detection portion, light blocking portion) 70 to move from the position shown in FIG. 5B to the position shown in FIG. 5C. If the elapsed time has exceeded the maximum time (step S4: Yes), the controller 130 considers the maximum time as the transit time.

The situation in which the elapsed time has exceeded the maximum time (step S4: Yes) corresponds to a situation in which the movable member (float, detection portion, light blocking portion) 70 moves very slowly from the position shown in FIG. 5B to the position shown in FIG. 5C or stops moving. A reason for the slow movement of the movable member (float, detection portion, light blocking portion) 70 may be that the viscosity of ink stored in the ink chamber 36 has become high, or may be that the movable member (float, detection portion, light blocking portion) 70 is stuck in the ink chamber 36.

Subsequently, the controller 130 resets an error flag, i.e., sets the error flag to "OFF" at step S7. The error flag is set to "ON" when the transit time is not within a threshold range (step S9: No). The error flag is set for each ink cartridge 30. The controller 130 stores the error flag in the EEPROM 134.

Subsequently, the controller 130 determines the threshold range based on the signal output from the temperature sensor 106 at step S8. The threshold range is compared with the transit time for estimating the viscosity of ink stored in the ink chamber 36. If the signal output from the temperature sensor 106 indicates that the temperature is relatively high, the controller 130 sets at least one of the upper limit value and the lower limit value of the threshold range lower. In other words, if the signal output from the temperature sensor 106 indicates that the temperature is relatively low, the controller 130 sets at least one of the upper limit value and the lower limit value of the threshold range higher.

Subsequently, the controller 130 compares the transit time determined at step S6 with the threshold range determined at step S8 and determines whether or not the transit time is within the threshold range at step S9. If the transit time is below the lower limit value, it is estimated that the viscosity of ink is too low. If the transit time is above the upper limit value, it is estimated that the viscosity of ink is too high. If the transit time is out of the threshold range (step S9: No), the controller 130 sets the error flag to "ON" at step S10. If the transit time is within the threshold range (step S9: Yes), the controller 130 skips the process of step S10.

Subsequently, the controller 130 sets the determination-complete flag to "ON" at step S11, and resets a near-empty flag, i.e., sets the near-empty flag to "OFF" at step S12. The near empty flag is set to "ON" when the ink cartridge 30 is determined to be in a near empty state (step S25: Yes). The near empty flag is set for each ink cartridge 30. The controller 130 stores the near-empty flag in the EEPROM 134.

Subsequently, the controller 130 determines whether or not the cover sensor 108 outputs the signal indicating that the cover of the cartridge mounting portion 110 is closed at step S13. If it is determined that the cover is open (step S13: No), the controller 130 repeats the process of step S2 and the processes that follow step S2. If it is determined that the cover is closed (step S13: Yes), the controller 130 determines at step S 14 whether or not a predetermined period of time has passed since it is determined that the cover is closed at step S 13.

If the predetermined period of time has passed (step S14: Yes), the controller 130 complete the processes of FIG. 7. If the predetermined period of time has not passed (step S14: No), the controller 130 repeats the process of step S2 and the processes that follow step S2. If the controller 130 determines that the cover of the cartridge mounting portion 110 is open (step S13: No) when the controller 130 is repeating the process of step S2 and the processes that follow step S2, the controller 130 cancels the counting of time it started when it determined that the cover was closed (step S13: Yes).

Figure 6B:
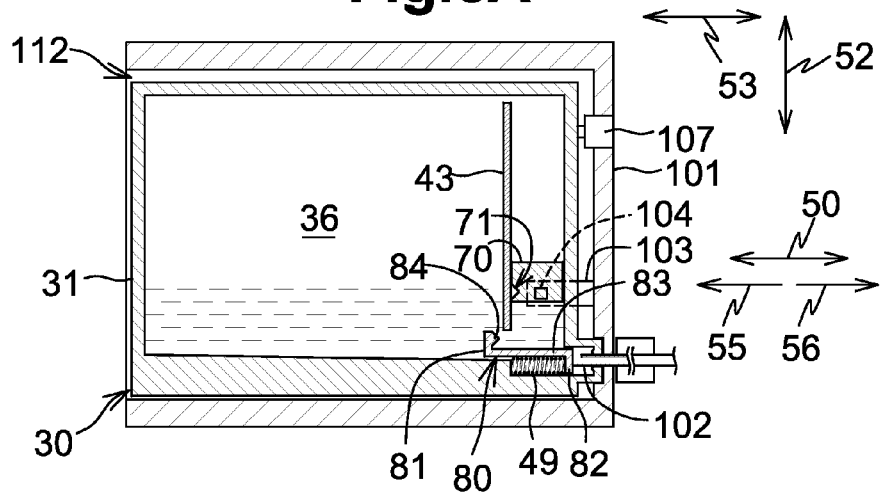
FIG. 6B is a cross-sectional view of the ink cartridge and the cartridge mounting portion when the ink cartridge is in a near-empty state.
Figure 6C:
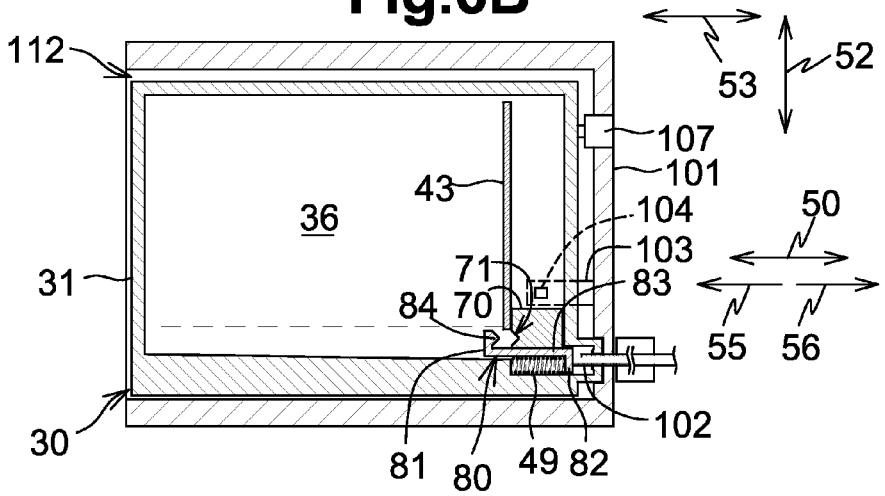
FIG. 6C is a cross-sectional view of the ink cartridge and the cartridge mounting portion when the ink cartridge is in an empty state.

When the mounting of the ink cartridge 30 to the cartridge mounting portion 110 has been completed and the cover is closed, the recording head 21 can perform image recording. As the recording head 21 ejects ink and thereby images are recorded, the amount of ink in the ink chamber 36 decreases. As the amount of ink in the ink chamber 36 decreases, the surface of ink in the ink chamber 36 lowers. When a portion of the movable member (float, detection portion, light blocking portion) 70 is exposed from the surface of ink and the surface of ink lowers, the movable member (float, detection portion, light blocking portion) 70 moves downward in the moving path or the free range from the position shown in FIG. 6A. When the lower end of the movable member (float, detection portion, light blocking portion) 70 reaches the detection position as shown in FIG. 6B, the detection signal output from the sensor 103 changes from the High-level signal to the Low-level signal. When the upper end of the movable member (float, detection portion, light blocking portion) 70 passes the detection position as shown in FIG. 6C, the detection signal output from the sensor 103 changes from the Low-level signal to the High-level signal.

Figure 8:
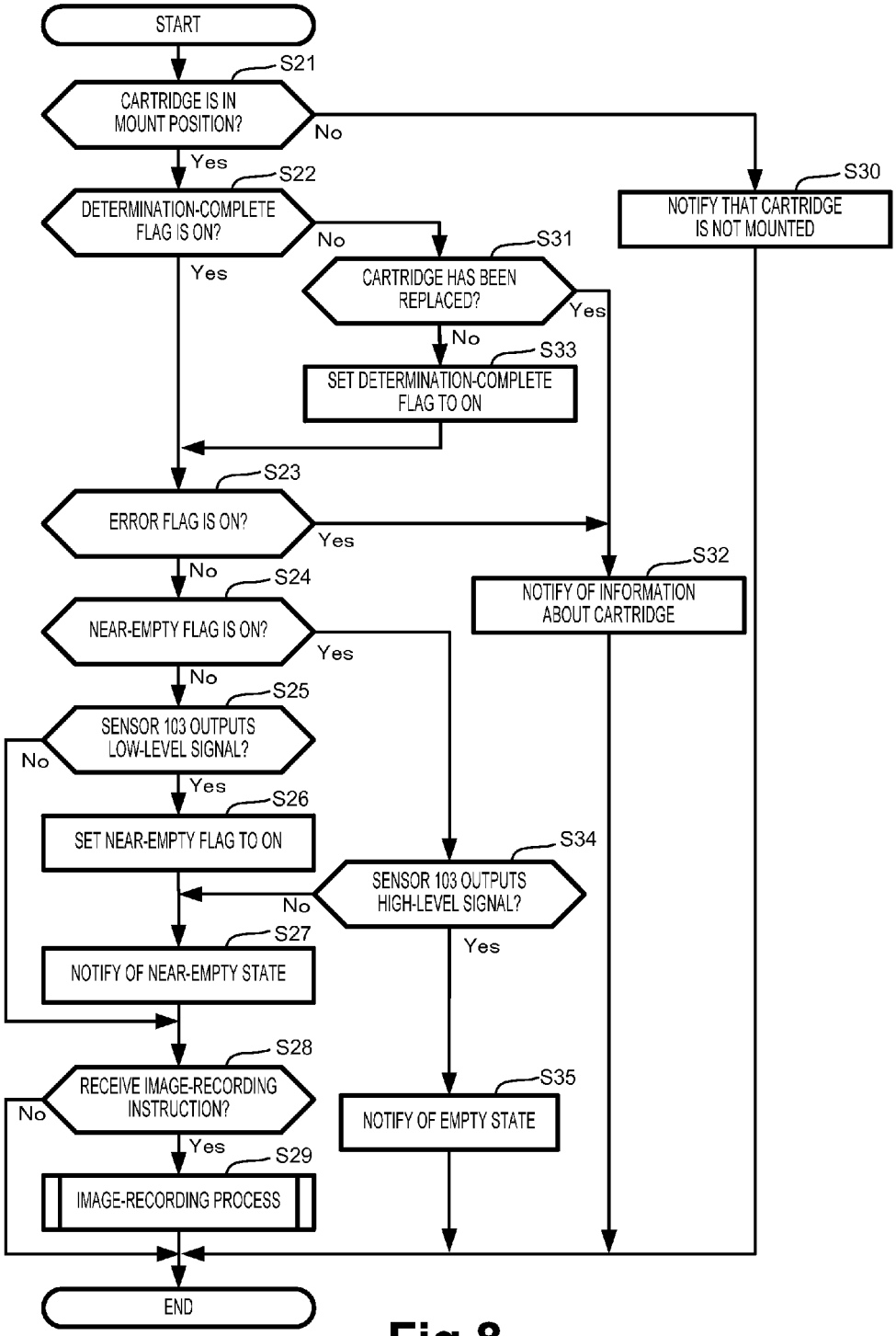
FIG. 8 is a flow chart of processes performed by the controller when the processes of FIG. 7 have been completed and the cover of the cartridge mounting portion is closed.

After completing the processes of FIG. 7, the controller 130 performs the processes of FIG. 8 repeatedly at a predetermined interval when the controller 130 receives from the cover sensor 108 the signal indicating that the cover of the cartridge mounting portion 110 is closed.

The controller 130 determines whether the mount sensor 107 outputs the signal indicating that the ink cartridge 30 is in the mount position at step S21. If the mount sensor 107 does not output the signal indicating that the ink cartridge 30 is in the mount position (step S21: No), the controller 130 notifies a user that the ink cartridge 30 is not mounted at step S 30, and completes the processes of FIG. 8. How to notify a user is not limited to a specific way, but the controller 130 may have the display 109 display a message or have a speaker (not shown) of the printer 10 sound out an audio message.

If the mount sensor 107 outputs the signal indicating that the ink cartridge 30 is in the mount position (step S21: Yes), the controller 130 determines whether the determination-complete flag is set to "ON" at step S22. If the determination-complete flag is set to "OFF" (step S22: No), the controller 130 performs the process of step S31. If the determination-complete flag is set to "ON" (step S22: Yes), the controller 130 performs the process of step S23.

The controller 130 asks a user if he or she has replaced the ink cartridge 30 at step S31. How to ask a user is not limited to a specific way, but the controller 130 may have the display 109 display a message or have a speaker (not shown) sound out an audio message. The controller 130 then waits for a signal to come from an input interface (not shown) of the printer 10. For instance, the input interface is an interface on which a user may give instructions to the printer 10 by pressing bottoms on it. If the controller 130 receives from the input interface a signal indicating that the ink cartridge 30 has been replaced (step S31: Yes), the controller 130 performs the process of step S32.

If the controller 130 receives from the input interface a signal indicating that the ink cartridge 30 has not been replaced (step S31: No), the controller 130 sets the determination-complete flag to "ON" at step S33, and then performs the process of step S23. The controller 130 determines whether the error flag is set to "ON" at step S23. If the error flag is set to "ON" (step S23: Yes), the controller 130 performs the process of step S32.

The controller 130 notifies a user of information about the ink cartridge 30 at step S32, and then completes the process of FIG. 8. If the controller 130 receives from the input interface the signal indicating that the ink cartridge 30 has been replaced (step S31: Yes), the controller 130 may notify a user that the replacement of the ink cartridge 30 has not been recognized at step S32. If the controller 130 determines that the error flag is set to "ON" (step S23: Yes), the controller 130 may notify a user that ink in the ink chamber 36 has deteriorated, or that the replacement of the ink cartridge 30 is needed. How to notify a user is not limited to a specific way, but the controller 130 may have the display 109 display a message or have a speaker (not shown) of the printer 10 sound out an audio message.

If the error flag is set to "OFF" (step S23: No), the controller 130 performs the process of step S24. The controller 130 determines whether the near-empty flag is set to "ON" at step S24. If the near-empty flag is set to "OFF" (step S24: No), the controller 130 determines whether the sensor 103 outputs the Low-level signal at step S25.

If the sensor 103 outputs the High-level signal (step S25: No), the controller 130 performs the process of step S28. If the sensor 103 outputs the Low-level signal (step S25: Yes), the controller 130 sets the near-empty flag to "ON" at step S26, and then notifies a user that the ink cartridge 30 is in the near-empty state, i.e., the amount of ink in the ink chamber 36 is low, i.e., becomes less than a threshold amount, at step S27. The situation in which the sensor 103 outputs the Low-level signal at step S25 may be a situation in which the movable member (float, detection portion, light blocking portion) 70 is in the detection position as shown in FIG. 6B. How to notify a user is not limited to a specific way, but the controller 130 may have the display 109 display a message or have a speaker (not shown) of the printer 10 sound out an audio message. Subsequently, the controller 130 performs the process of step S28.

The controller 130 determines whether it receives an image-recording instruction at step S28. If the controller 130 does not receive the image-recording instruction (step S28:

No), the controller 130 completes the processes of FIG. 8. If the controller 130 receives the image-recording instruction (step S28: Yes), the controller 130 directly or indirectly controls the recording head 21, the paper feed roller 23, the conveying roller pair 25, the discharge roller pair 27, etc. to record an image of a sheet of recording paper at step S29, and then complete the processes of FIG. 8. The controller 130 may record an image on one sheet of recording paper when performing the process of step S29 once, or the controller 130 may record images corresponding to all the image date that the controller 130 received when performing the process of step S29 once.

If the near-empty flag is set to "ON" (step S24: Yes), the controller 130 determines whether the sensor 103 outputs the High-level signal at step S34. If the sensor 103 outputs the Low-level signal (step S34: No), the controller 130 performs the process of step S27. If the sensor 103 outputs the High-level signal (step S34: Yes), the controller 130 notifies a user that the ink cartridge 30 is in the empty state, i.e., the amount of ink in the ink chamber 36 is zero or almost zero, at step S 35, and then completes the processes of FIG. 8. The situation in which the sensor 103 outputs the High-level signal at step S34 may be a situation in which the movable member (float, detection portion, light blocking portion) 70 is in the position as shown in FIG. 6C. How to notify a user is not limited to a specific way, but the controller 130 may have the display 109 display a message or have a speaker (not shown) of the printer 10 sound out an audio message.

If the error flag is set to "ON" (step S23: Yes), the controller 130 does not perform the process of step S29, i.e., the image-recording process. In other words, the controller 130 skips step S29 and thereby restricts the consumption of ink by the recording head 21.

[Advantages]

According to the above-described embodiment, when the operation portion 82 moves from the first position to the second position, the movable member (float, detection portion, light blocking portion) 70 moves up within ink. The movable member (float, detection portion, light blocking portion) 70 moves up against viscous and inertial resistances caused by ink, different from when it floats on the surface of ink and moves down as the surface of ink lowers. As a result, the velocity of the movable member (float, detection portion, light blocking portion) 70 moving upward depends on the viscosity of ink in the ink chamber 36. By measuring the transit time required for movable member (float, detection portion, light blocking portion) 70 to pass the detection position, the viscosity of ink in the ink chamber 36 can be estimated, e.g. whether the viscosity of ink is within a certain range or not can be estimated. That is, since the distance from the position of the movable member (float, detection portion, light blocking portion) 70 shown in FIG. 5B to the position of the movable member (float, detection portion, light blocking portion) 70 shown in FIG. 5C is a predetermined constant distance between two points, the velocity of the movable member (float, detection portion, light blocking portion) 70 can be specified by measuring the time required for movable member (float, detection portion, light blocking portion) 70 to move between the two points. The transit time is an example of a physical quantity, based on which the velocity of the movable member (float, detection portion, light blocking portion) 70 can be specified. Nevertheless, the example of the physical quantity is not limited to the transit time. Another example of the physical quantity may be a distance the movable member (float, detection portion, light blocking portion) 70 moves during a predetermined period of time.

According to the above-described embodiment, the viscosity of ink can be estimated at a time when the mounting of the ink cartridge 30 to the cartridge mounting portion 110 is completed. Therefore, the degree of deterioration of ink can be estimated by calculating the transit time even when the ink cartridge 30 has not been mounted to the printer 10 and been unused for a long time. Moreover, if a plurality of ink cartridges 30 storing inks having different viscosities are configured to be mounted to the same cartridge mounting portion 110, it is possible to determine which ink cartridge 30 is mounted by calculating the transit time.

According to the above-described embodiment, when the transit time is out of the threshold range (step S9: No), the controller 130 restricts the performance of the recording head 29, i.e., skips step S29. Therefore, a trouble of the recording head 21 which may be caused by an unusual viscosity of ink can be prevented. Nevertheless, it is not always necessary to skip step S29. In another embodiment, if the error flag is "ON" (step S23: Yes), the process of step S32 notifying a user of the information about the ink cartridge 30 may be performed, but the controller 130 may let the user decide whether image recording should be performed. In such a case, the processes performed by the controller 130 may be different from the ones of FIGS. 7 and 8, but the description thereof is omitted here.

Moreover, in another embodiment, if the error flag is "ON" (step S23: Yes), steps S24 to S29 may not be skipped, but the controller 130 may control the head control board 21A, such that the driving voltages applied to the piezoelectric actuators 29A are adjusted at step S 29. More specifically, the controller 130 outputs different control signals to the head control board 21A, such that the driving voltages applied to the piezoelectric actuators 29A are adjusted for the amounts of ink ejected from the nozzles 29 to be the same amount between when the transit time is within the threshold range and when the transit time is out of the threshold range. That is, when the transit time is below the lower limit value of the threshold range (it is estimated that the viscosity of ink is too low), the driving voltages are made smaller than the driving voltages when the transit time is within the threshold range. When the transit time is above the upper limit value of the threshold range (it is estimated that the viscosity of ink is too high), the driving voltages are made larger than the driving voltages when the transit time is within the threshold range. In this case, if a plurality of ink cartridges 30 storing inks having different viscosities is configured to be mounted to the same cartridge mounting portion 110, it is possible to drive the piezoelectric actuators 29A with suitable voltages according to types of ink. The actuators may not be limited to the piezoelectric actuators 29A, but may be thermal-type actuators, which ejects ink from the nozzles 29 by applying heat to ink and thereby generating bubbles in ink.

In addition to controlling the head control board 21A, such that the driving voltages applied to the piezoelectric actuators 29A are adjusted, the controller 130 may control a purge operation, in which ink is forcedly discharged from the nozzles 29 of the recording head 21. For instance, if the controller 130 determines that the error flag is set to "ON" (step S23: Yes), the controller 130 may control the purge operation, such that ink is discharged with more pressure applied thereto than if the controller 130 determines that the error flag is set to "OFF" (step S23: No). More specifically, when ink is discharged from the nozzles 29 of the recording head 21 by a suction pump, the controller 130 may control the suction pump, such that the suction pump sucks ink with more suction pressure if the error flag is set to "ON." With this control, air bubbles or thickened ink in the recording head 21 can be reliably discharged by the purge operation even if the viscosity of ink is high, and ink can be reliably supplied from the ink tube 20 to the recording head 21.

In the above-described embodiment, both of the upper limit value and the lower limit value of the threshold range are specified. Nevertheless, in another embodiment, at least one of the upper limit value and the lower limit value of the threshold range is specified.

According to the above-described embodiment, the movable member (float, detection portion, light blocking portion) 70 moves up toward the surface of ink with the buoyancy acting thereon, and moves down as ink in the ink chamber 36 is consumed and the surface of ink lowers. When the movable member (float, detection portion, light blocking portion) 70 moves down and reaches the detection position again, the near-empty state and the empty state can be determined. Nevertheless, the process for determining the near-empty state and the empty state (steps S12, S24 to S27, S34, and S35) are not always necessary, but can be removed from the processes of FIGS. 7 and 8.

The viscosity of ink typically changes when the surrounding temperature changes. For example, when the temperature is high, the viscosity is low, and when the temperature is low, the viscosity is high. The controller 130 may control the head control board 21A, such that the driving voltages applied to the piezoelectric actuators 29A are adjusted based on the temperature. More specifically, when the temperature is high, the controller 130 outputs control signals to the head control board 21A, such that low driving voltages are applied to the piezoelectric actuators 29A. When the temperature is low, the controller 130 outputs control signals to the head control board 21A, such that high driving voltages are applied to the piezoelectric actuators 29A. There is an optimum threshold range of the viscosity of ink, corresponding to the driving voltages applied to the piezoelectric actuators 29A which are determined by the temperature. In other word, it is preferable to set the threshold range of the viscosity of ink based on the temperature. Therefore, according to the above-described embodiment, the controller 130 determines the threshold range based on the temperature at step S8. How to determine the threshold range is not limited to a specific way, but the controller 130 may select one suitable threshold range based on the temperature out of a plurality of threshold ranges stored in the ROM 132, or may calculate the upper limit value and/or the lower limit value of the threshold range as a function of the temperature value. Nevertheless, step S8 for determining the threshold range based on the temperature may be removed, and a fixed threshold range can be used at step S9, when, for example, the driving voltages applied to the piezoelectric actuators 29A are not adjusted based on the temperature.

According to the above-described embodiment, the sensor 103 is an optical sensor, but the sensor 103 is not limited to an optical sensor. The sensor 130 may be a magnetic sensor such as a Hall effect sensor, which is configured to output different signals based on magnetic flux density generated by the detection portion 70 which may comprise magnet. Moreover, the sensor 130 may be any known sensor.

According to the above-described embodiment, the controller 130 stores the determination-complete flag, the error flag, and the near-empty flag in the EEPROM 134, but the controller 130 may store one or all of the flags in a memory of an IC chip (not shown) mounted on the ink cartridge 30. According to the above-described embodiment, the controller 130 comprises the CPU 131 and the ASIC 135, but the controller 130 may not comprise the ASIC 135 and the CPU 131 may perform all the processes of FIGS. 7 and 8 by reading out a program stored in the ROM 132. On the contrary, the controller 130 may not comprise the CPU 131, and may comprise hardware only, such as the ASIC 135 or FPGA. Moreover, the controller 130 may comprise a plurality of CPUs 131 and/or a plurality of ASICs 135.

According to the above-described embodiment, the operation portion 82 is moved by the hollow tube 102 contacting and pushing the operation portion 82, but how to move the operation portion 82 is not limited thereto. For instance, in another embodiment, the ink cartridge 30 may comprise a valve configured to selectively open and close the ink supply opening 61. The valve and the restriction member 80 may be different and separate members. The valve may be moved by the hollow tube 102 contacting and pushing the valve. The operation portion 82 may be moved by a member, which is different from the hollow tube 102, contacting and pushing the operation portion 82.

Moreover, in another embodiment, the operation portion 82 may extend out of the ink cartridge 30, such that when the ink cartridge 30 is mounted to the cartridge mounting portion 110, the extended portion of the operation portion 82 may contact the end surface of the case 101 of the cartridge mounting portion 110, and thereby the operation portion 82 moves from the first position to the second position. Nevertheless, in such a case, a user may accidentally touch the extended portion of the operation portion 82 and the movable member 70 may be released at an unintended timing. Therefore, it is preferable (but not limited to) that the operation portion 82 is positioned within the ink cartridge 30, e.g., positioned within the frame 31.

According to the above-described embodiment, the movement of the movable member (float, detection portion, light blocking portion) 70 is restricted by the engagement between the protrusion 84 of the restriction portion 81 and the recessed portion 71 of the movable member (float, detection portion, light blocking portion) 70, but how to restrict the movement of the movable member (float, detection portion, light blocking portion) 70 is not limited thereto.

First Modified Embodiment

Figure 9:
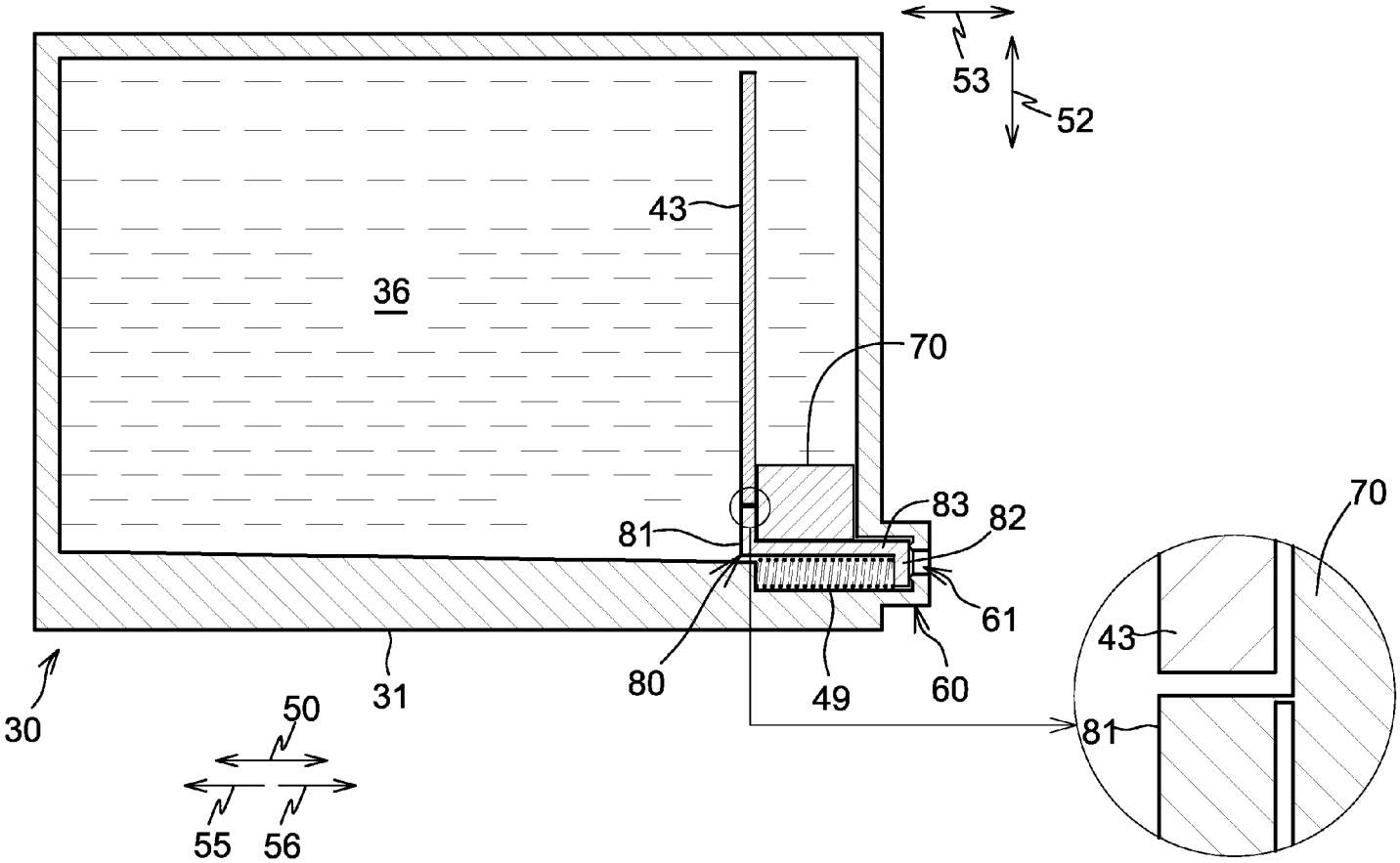
FIG. 9 is a cross-sectional view of an ink cartridge according to a first modified embodiment.

Referring to FIG. 9, an ink cartridge 30 according to a first modified embodiment is described. The descriptions of the parts which are common between the above-described embodiment and the first modified embodiment may be omitted, but the parts of the first modified embodiment which are different from the parts of the above-described embodiment are described. Similarly, the descriptions of the parts which are common among the above-described embodiment, the first modified embodiment, and the later-described further modified embodiments may be omitted if they are once described. Moreover, the parts of the above-described embodiment, the first modified embodiment, and the later-described further modified embodiments can be arbitrarily combined as long as the object of the invention is achieved.

In the ink cartridge 30 according to the first modified embodiment, the movable member (float, detection portion, light blocking portion) 70 is connected to the restriction portion 81 when the operation portion 82 is initially positioned in the first position. When the operation portion 82 moves from the first position to the second position, the connected portion between the movable member (float, detection portion, light blocking portion) 70 and the restriction portion 81 are broken. Therefore, when the operation portion 82 is in the second position, the movable member (float, detection portion, light blocking portion) 70 is disconnected from the restriction portion 81. How to connect the movable member (float, detection portion, light blocking portion) 70 to the restriction portion 81 is not limited to a specific way, but the movable member (float, detection portion, light blocking portion) 70 may be bonded to the restriction portion 81 with adhesive, or the movable member (float, detection portion, light blocking portion) 70 and the restriction member 80 may be integrally molded. Preferably, the strength of the connected portion between the movable member (float, detection portion, light blocking portion) 70 and the restriction portion 81 is strong enough not to be broken by vibration or shock the ink cartridge 30 receives when it is transported, but is weak enough not to make the mounting of the ink cartridge 30 to the cartridge mounting portion 110 difficult.

In the above-described embodiment and the first modified embodiment, the transit time is measured between when the upper end of the movable member (float, detection portion, light blocking portion) 70 reaches the detection position to when the lower end of the movable member (float, detection portion, light blocking portion) 70 passes the detection position. The position and the velocity of the movable member (float, detection portion, light blocking portion) 70 can be unstable right after the movable member (float, detection portion, light blocking portion) 70 is released. According to the above-described embodiment and the first modified embodiment, the transit time is measured after the position and the velocity of the movable member (float, detection portion, light blocking portion) 70 are stabilized. Therefore, the viscosity of ink can be estimated more accurately. However, how to measure the transit time is not limited to the way described in the above-described embodiment and the first modified embodiment, but the transit time may be measured between when the movable member (float, detection portion, light blocking portion) 70 is released and to when movable member (float, detection portion, light blocking portion) 70 reaches the detection position.

Second Modified Embodiment

Figure 10A:
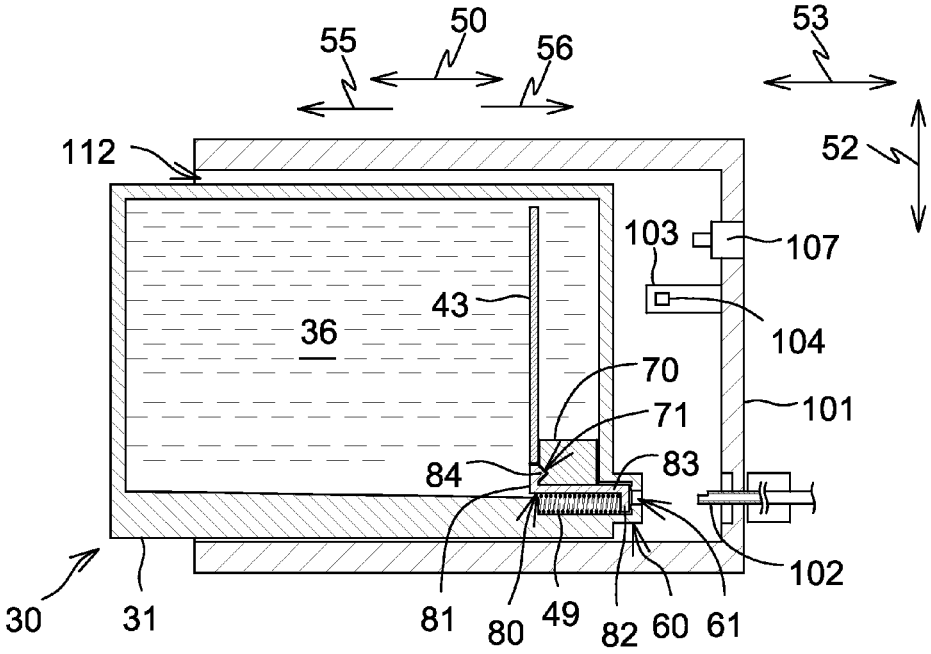
FIG. 10A is a cross-sectional view of an ink cartridge and a cartridge mounting portion according to a second modified embodiment during insertion of the ink cartridge into the cartridge mounting portion.
Figure 10B:
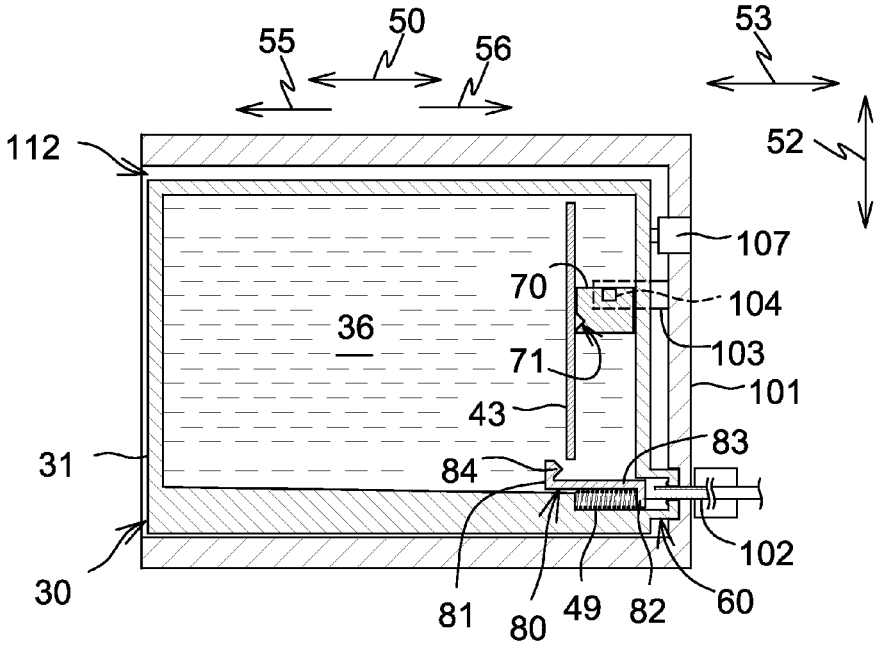
FIG. 10B is a cross-sectional view of the ink cartridge and the cartridge mounting portion according to the second modified embodiment when mounting of the ink cartridge to the cartridge mounting portion has been completed.

Referring to FIGS. 10A and 10B, an ink cartridge 30 and a cartridge mounting portion 110 according to a second modified embodiment are described. The controller 130 determines that the movable member (float, detection portion, light blocking portion) 70 is released from the restriction portion 81 when the mount sensor 107 outputs the signal indicating that the ink cartridge 30 is in the mount position. In other words, the controller 130 determines that the movable member (float, detection portion, light blocking portion) 70 is released from the restriction portion 81 at a timing when the detection signal output from the mount sensor 107 changes from the signal indicating that the ink cartridge 30 is not in the mount position to the signal indicating that the ink cartridge 30 is in the mount position.

The timing when the movable member (float, detection portion, light blocking portion) 70 is released from the restriction portion 81 and the timing when the mount sensor 107 outputs the signal indicating that the ink cartridge 30 is in the mount position are the same or close. Therefore, the latter timing is presumed as the former timing. The controller 130 measures, as the transit time, a time from when the movable member (float, detection portion, light blocking portion) 70 is released from the restriction portion 81 to when the sensor 103 outputs the Low-level signal.

More specifically, in this second modified embodiment, the controller 130 determines whether the detection signal output from the mount sensor 107 changes from the signal indicating that the ink cartridge 30 is not in the mount position to the signal indicating that the ink cartridge 30 is in the mount position at step S2 in the flowchart of FIG. 7. Moreover, the controller 130 determines whether the detection signal output from the sensor 103 changes from the High-level signal to the Low-level signal at step S5 in the flowchart of FIG. 7.

That is, the controller 130 measures a time required for the movable member (float, detection portion, light blocking portion) 70 to move from the position shown in FIG. 10A to the position shown in FIG. 10B. Strictly speaking, because the above-described presumption about the timing is made, the controller 130 measures a time required for the movable member (float, detection portion, light blocking portion) 70 to move from a position when the ink cartridge 30 reaches the mount position to the position shown in FIG. 10B. The controller 130 measures a time required for movable member (float, detection portion, light blocking portion) 70 to move between two points in the moving path.

In the above-described embodiment, the first modified embodiment, and the second modified embodiment, the hollow tube 102 is used to have the restriction member 80 release the movable member (float, detection portion, light blocking portion) 70. Nevertheless, the hollow tube 102 is just an example of what causes the release of the movable member (float, detection portion, light blocking portion) 70.

Third Modified Embodiment

Figure 11A:
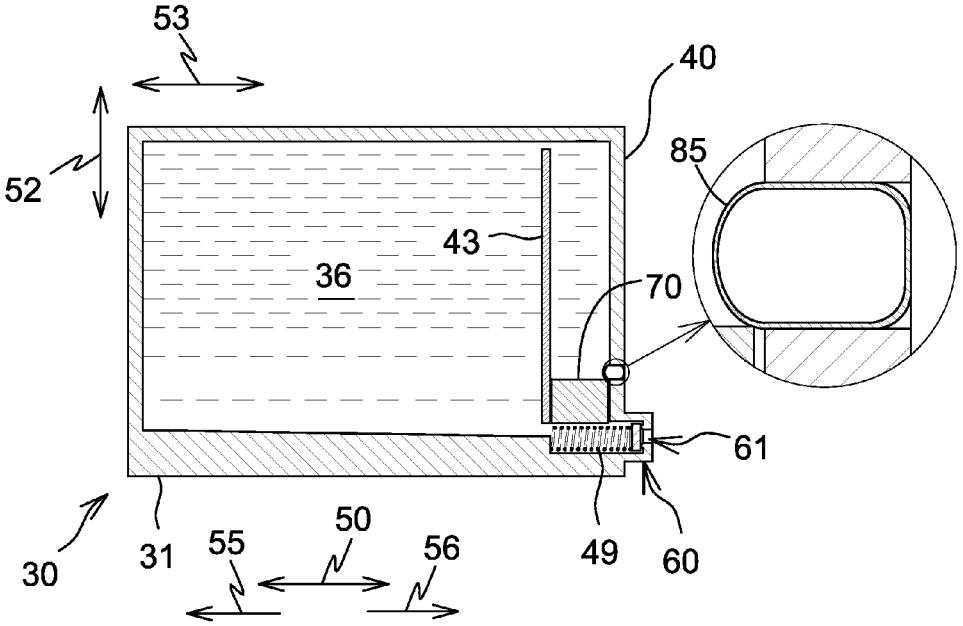
FIG. 11A is a cross-sectional view of an ink cartridge according to a third modified embodiment before the ink cartridge is mounted to a cartridge mounting portion.
Figure 11B:
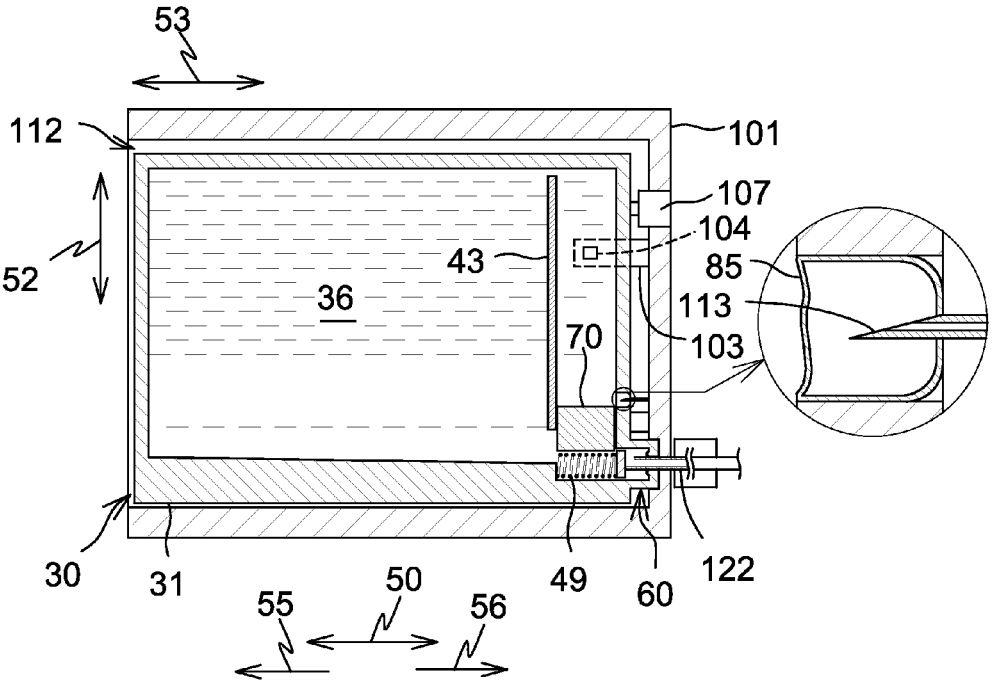
FIG. 11B is a cross-sectional view of the ink cartridge and a cartridge mounting portion according to the third modified embodiment when mounting of the ink cartridge to the cartridge mounting portion has been completed.

Referring to FIGS. 11A and 11B, an ink cartridge 30 and a cartridge mounting portion 110 according to a third modified embodiment are described. The restriction member of the ink cartridge 30 comprises a gas bag 85 positioned in the front wall 40. The gas bag 85 is penetrated through the front wall 40 in the depth direction 53. The gas bag 85 is filled with gas and bulges into the ink chamber 36. The state of the gas bag 85 is called a bulging state. The gas bag 85 in the bulging state contacts the upper end of the movable member (float, detection portion, light blocking portion) 70 and thereby functions as a restriction member restricting the movement of the movable member (float, detection portion, light blocking portion) 70. The restriction portion 81 and the connection portion 83 are omitted in the ink cartridge 30 according to the third modified embodiment, and the operation portion 82 is replaced with a valve configured to selectively open and close the ink supply opening 61. The coil spring 49 (or other suitable biasing member) is configured to bias the valve, such that the valve closes the ink supply opening 61.

The cartridge mounting portion 110 according to the third modified embodiment comprises a gas extraction tube 113 extending from the end surface in the removal direction 55. The gas extraction tube 113 is positioned so as to face the gas bag 85. When the ink cartridge 30 is mounted to the cartridge mounting portion 110, the gas extraction tube 113 penetrates through the gas bag 85 and the tip end of the extraction tube 113 reaches the inside of the gas bag 85. When this occurs, the gas inside the gas bag 85 is discharged through the gas extraction tube 113, and the gas bag 85 contracts. The state of the gas bag 85 is called a contracted state. Therefore, the amount of gas in the gas bag 85 when the gas bag 85 is in the contracted state is less than the amount of gas in the gas bag 85 when the gas bag 85 is in the bulging state. The gas bag 85 in the contracted state does not contact the movable member (float, detection portion, light blocking portion) 70 and releases the movable member (float, detection portion, light blocking portion) 70.

When the gas extraction tube 113 penetrates through the gas bag 85 is not limited to when the ink cartridge 30 is mounted to the cartridge mounting portion 110. In another embodiment, the timing when the ink cartridge 30 is mounted to the cartridge mounting portion 110 and the timing when the movable member (float, detection portion, light blocking portion) 70 is released may not be the same. For instance, in another embodiment, the gas extraction tube 113 may be retracted from the end surface, and the controller 130 may drive a motor (not shown) to move the gas extraction tube 113 out of the end surface into the gas bag 85 after the mounting of the ink cartridge 30 to the cartridge mounting portion 110 is completed. In another embodiment, the gas bag 85 may not be positioned in the front wall 40, but may be positioned in another wall of the frame 31.

Fourth Modified Embodiment

Referring to FIGS. 12 A and 12B, an ink cartridge 30 and a cartridge mounting portion 110 according to a fourth modified embodiment are described. The ink cartridge 30 according to the fourth modified embodiment comprises a movable member 70A instead of the movable member (float, detection portion, light blocking portion) 70. In this fourth modified embodiment, the movable member 70A comprises a detection portion and a float, and the movable member 70A, the detection portion and the float are one and the same member, similarly to the above-described embodiment. The movable member (float, detection portion) 70A also comprises a light blocking portion, similarly to the above-described embodiment, but also comprises a light passing portion. More specifically, the light blocking portion comprises a plurality of light blocking portions and the light passing portion comprises at least one light passing portion. The plurality of light blocking portions and the at least one light passing portion are positioned alternately in the moving direction of the movable member (float, detection portion) 70A. In this fourth modified embodiment, the moving direction is the height direction 52. In other words, each one of the at least one light passing portion is positioned between two of the plurality of light blocking portions in the moving direction of the movable member (float, detection portion) 70A. In this fourth modified embodiment, the light passing portion is a slit formed between the light blocking portions. The slit is formed though the movable member (float, detection portion) 70A in the direction in which the light emitting portion 104 and the light receiving portion 105 are aligned, i.e., in the width direction 51. The slit allows the light emitted from the light emitting portion 104 to pass therethrough in the width direction 51.

Figure 12A:
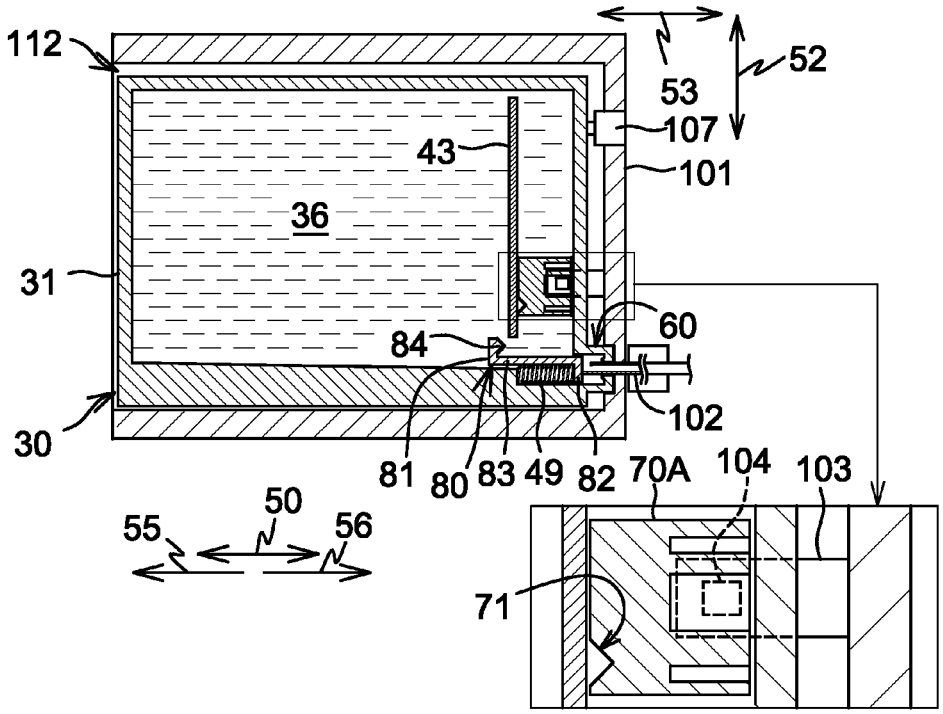
FIG. 12A is a cross-sectional view of an ink cartridge and a cartridge mounting portion according to a fourth modified embodiment when a light passing portion is in a detection position.
Figure 12B:
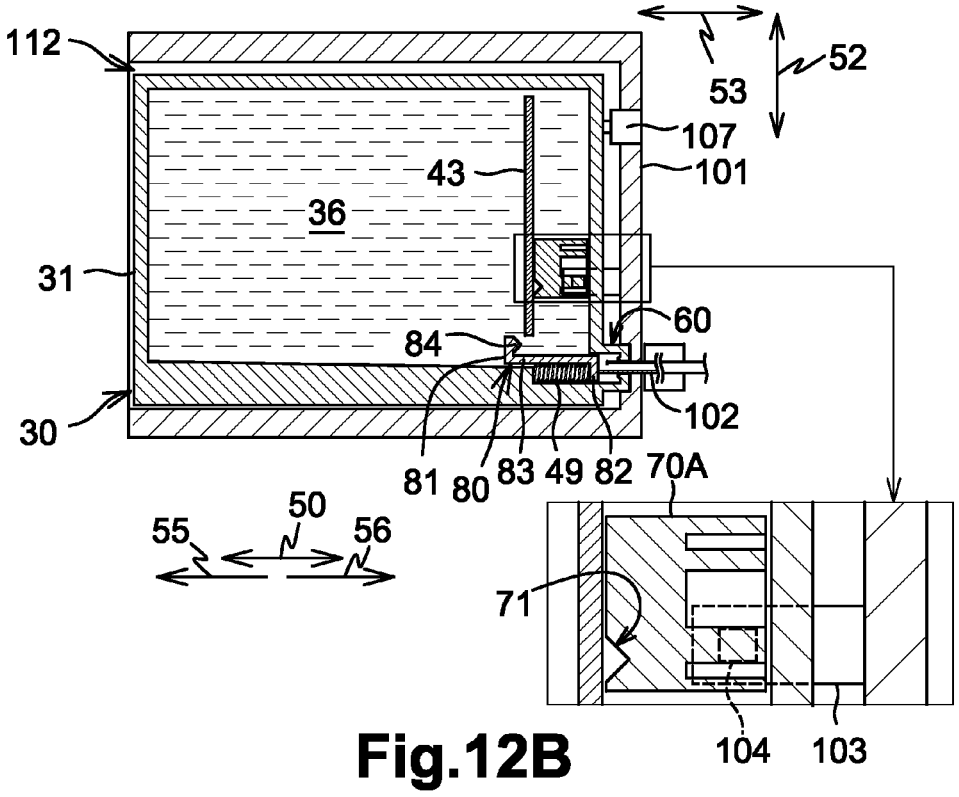
FIG. 12B is a cross-sectional view of the ink cartridge and the cartridge mounting portion according to the fourth modified embodiment, when a light blocking portion is in the detection position.

Referring to FIG. 12A, when the slit is in the detection position, the sensor 103 outputs the High-level signal. Referring to FIG. 12B, when the light blocking portion is in the detection position, the sensor 103 outputs the Low-level signal. Different types of ink cartridges 30 have different dimensions of the slits in the moving direction (the height direction 52), different number of slits, different dimensions of the light blocking portions in the moving direction (the height direction 52), and/or different number of light blocking portions. For instance, one ink cartridge 30 may have one slit and another ink cartridge 30 may have two slits. In addition or alternatively, one ink cartridge 30 may have a longer slit and another ink cartridge 30 may have a shorter slit. Therefore, the sensor 103 outputs different patterns of detection signals or different combinations of detection signals depending on which types of ink cartridges 30 are mounted to the cartridge mounting portion 110. The controller 130 determines a type of ink cartridge 30 based on a pattern or combination of detections signals output from the sensor 103 when the movable member (float, detection portion) 70A passes the detection position. The light passing portion may not be limited to a slit. For instance, in another embodiment, the light passing portion may be a transparent synthetic resin.

Fifth Modified Embodiment

Figure 13A:
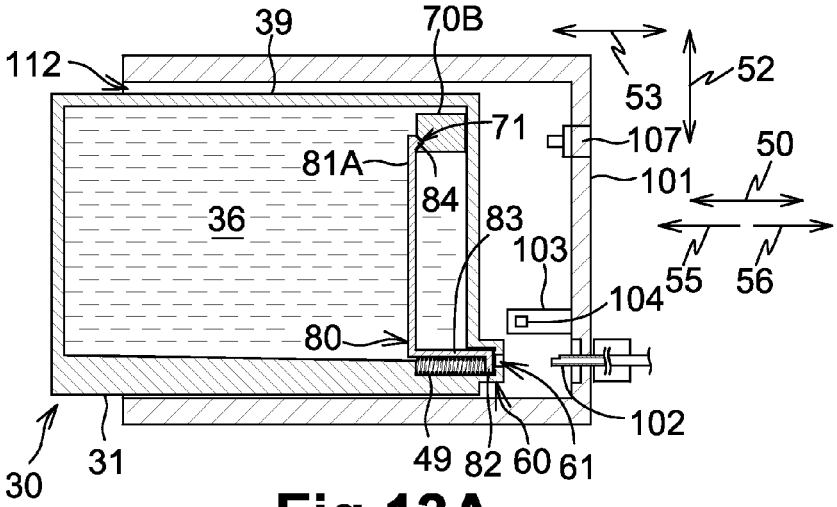
FIG. 13A is a cross-sectional view of an ink cartridge and a cartridge mounting portion according to a fifth modified embodiment during insertion of the ink cartridge into the cartridge mounting portion.
Figure 13B:
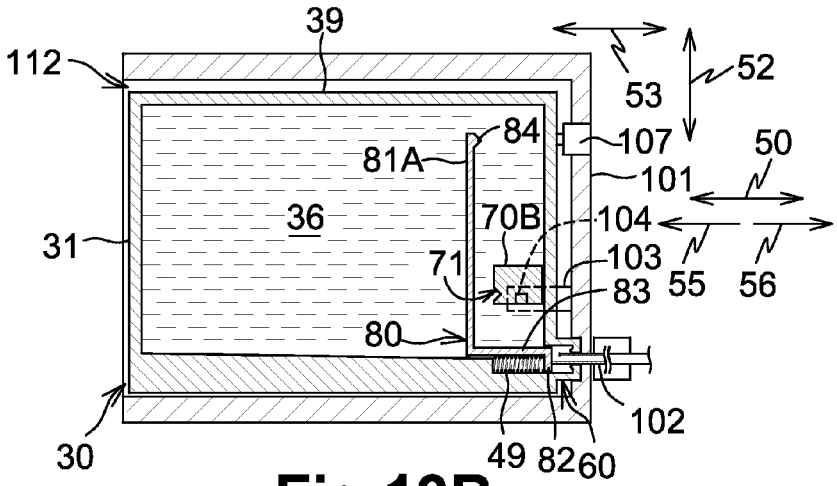
FIG. 13B is a cross-sectional view of the ink cartridge and the cartridge mounting portion according to the fifth modified embodiment when mounting of the ink cartridge to the cartridge mounting portion has been completed and the lower end of a movable member is in a detection position.
Figure 13C:
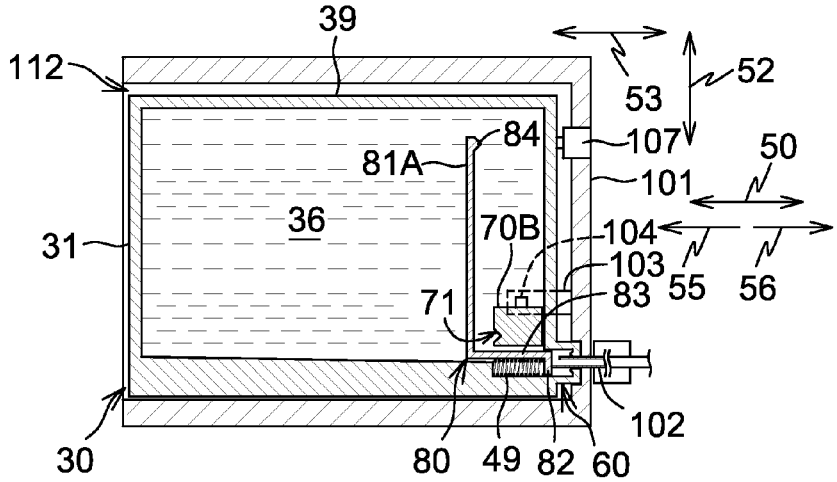
FIG. 13C is a cross-sectional view of the ink cartridge and the cartridge mounting portion according to the fifth modified embodiment when mounting of the ink cartridge to the cartridge mounting portion has been completed and the upper end of the movable member is in the detection position.

Referring to FIGS. 13A to 13C, an ink cartridge 30 and a cartridge mounting portion 110 according to a fifth modified embodiment are described. The ink cartridge 30 according to the fifth modified embodiment comprises a movable member 70B instead of the movable member (float, detection portion, light blocking portion) 70. The movable member 70B comprises a detection portion and an anchor. In this description, when it is described that a movable member comprises a detection portion and an anchor it at least means that the movable member comprises the detection portion and the anchor as portions of the movable member, or that the movable member comprises the detection portion and the anchor as the entirety of the movable member. In this fifth modified embodiment, the movable member 70B, the detection portion, and the anchor are one and the same member. The movable member (anchor, detection portion) 70B has a specific gravity which is greater than the specific gravity of ink stored in the ink chamber 36. When the movable member (anchor, detection portion) 70B is released from the restriction portion 81, the movable member (anchor, detection portion) 70B moves downward due to the gravity acting on the movable member (anchor, detection portion) 70B in a free range within the ink chamber 36. The movable member (anchor, detection portion) 70B comprises a light blocking portion. In this fifth modified embodiment, the movable member (anchor, detection portion) 70B comprises the light blocking portion as its entirety. That is, the movable member 70B, the detection portion, the anchor, and the light blocking portion are one and the same member. The movable member (anchor, detection portion, light blocking portion) 70B is configured to block the light emitted by the light emitting portion 104 of the sensor 103, similarly to the above-described embodiment. The movable member (anchor, detection portion, light blocking portion) 70B comprises the recessed portion 71 at its wall surface facing the removal direction 55, similarly to the above-described embodiment.

In this fifth modified embodiment, the restriction member 80 comprises a restriction portion 81A instead of the restriction portion 81. The restriction portion 81A has a longer dimension than the restriction portion 81 in the height direction 52. The restriction portion 81A extends up to a position adjacent to the top wall 39. When the operation portion 82 is in the first position, the protrusion 84 engages with the recessed portion 71 of the movable member (anchor, detection portion, light blocking portion) 70B, such that the movement of the movable member (anchor, detection portion, light blocking portion) 70B is restricted within a restricted range. In this embodiment, the protrusion 84 has a wedge shape and the recessed portion 71 has the corresponding shape. Nevertheless, the shapes of the protrusion 84 and the recessed portion 71 are not limited only to the wedge shape. The movable member (anchor, detection portion, light blocking portion) 70B may be made completely immovable by the restriction portion 81. In such a case, the restricted range is zero. The movable member (anchor, detection portion, light blocking portion) 70B may slightly move within the restricted range to the extent that the dimensional errors of the protrusion 84 and the recessed portion 71 allow. The movable member (anchor, detection portion, light blocking portion) 70B may move within the restricted range as long as movable member (anchor, detection portion, light blocking portion) 70B does not reach the detection position. The restricted range is positioned above the detection position.

When the operation portion 82 is in the second position, the protrusion 84 is positioned away from the recessed portion 71 and thereby the restriction portion 81A releases the movable member (anchor, detection portion, light blocking portion) 70B, such that the movable member (anchor, detection portion, light blocking portion) 70B is positioned in the free range which is below the restricted range. The detection position is in the free range.

Referring to FIGS. 13A to 13C, when the hollow tube 102 is inserted into the ink supply portion 60 through the ink supply opening 61 and pushes the operation portion 82 in the removal direction 55 against the biasing force of the coil spring 49, the operation portion 82 moves from the first position to the second position. As a result, the movable member (anchor, detection portion, light blocking portion) 70B is released. The movable member (anchor, detection portion, light blocking portion) 70B released from the restriction portion 81A moves downward in the free range. When the lower end of the movable member (anchor, detection portion, light blocking portion) 70B reaches the detection position as shown in FIG. 13B, the detection signal output from the sensor 103 changes from the High-level signal to the Low-level signal. Subsequently, referring to FIG. 13C, the movable member (anchor, detection portion, light blocking portion) 70B moves further downward. When the upper end of the movable member (anchor, detection portion, light blocking portion) 70B passes the detection position, the detection signal output from the sensor 103 changes from the Low-level signal to the High-level signal.

Similarly to the first modified embodiment, the movable member (anchor, detection portion, light blocking portion) 70B may be connected to the restriction portion 81A when the operation portion 82 is initially positioned in the first position. When the operation portion 82 moves from the first position to the second position, the connected portion between the movable member (anchor, detection portion, light blocking portion) 70B may be broken. Therefore, when the operation portion 82 is in the second position, the movable member (anchor, detection portion, light blocking portion) 70B may be disconnected from the restriction portion 81A.

Sixth Modified Embodiment

Figure 14A:
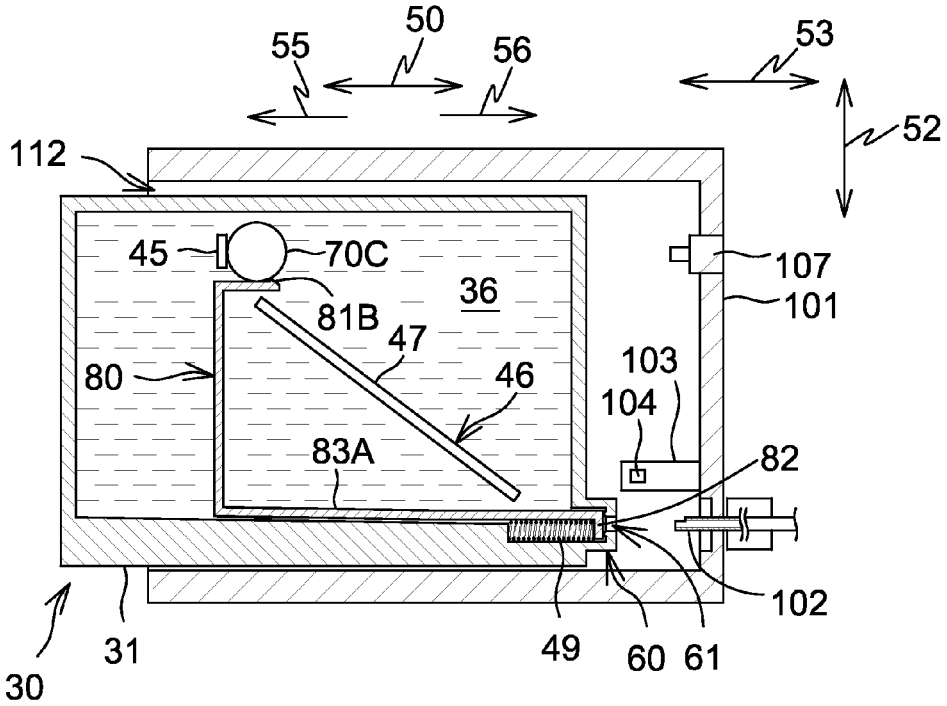
FIG. 14A is a cross-sectional view of an ink cartridge and a cartridge mounting portion according to a sixth modified embodiment during insertion of the ink cartridge into the cartridge mounting portion.
Figure 14B:
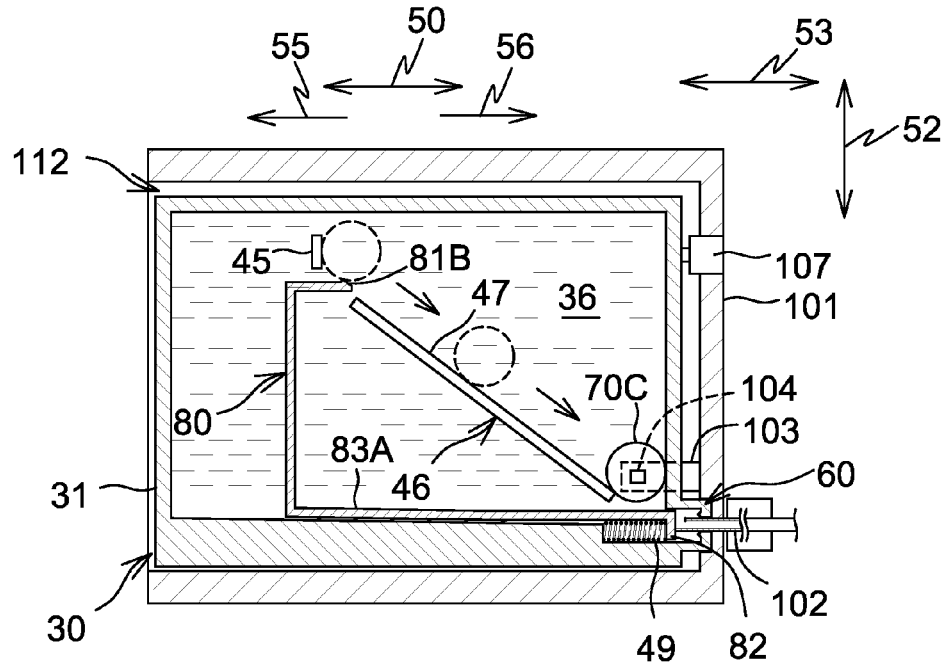
FIG. 14B is a cross-sectional view of the ink cartridge and the cartridge mounting portion according to the sixth modified embodiment when mounting of the ink cartridge to the cartridge mounting portion has been completed.

Referring to FIGS. 14A to 14B, an ink cartridge 30 and a cartridge mounting portion 110 according to a sixth modified embodiment are described. The ink cartridge 30 according to this sixth modified embodiment comprises a movable member 70C. The movable member 70C comprises a detection portion, an anchor, and a light blocking portion. The movable member 70C, the detection portion, the anchor and the light blocking portion are one and the same member, similarly to the fifth modified embodiment.

In this sixth modified embodiment, the restriction member 80 comprises a restriction portion 81B instead of the restriction portion 81 and a connection portion 83A instead of the connection portion 83. The connection portion 83A has a longer dimension than the connection portion 83 in the depth direction 53. The connection portion 83A extends to a position closer to the rear wall 41 than to the front wall 40. The restriction portion 81B comprises a first portion extending upward in the height direction 52 from the rear end of the connection portion 83A and a second portion extending frontward in the depth direction 53 from the upper end of the first portion of the restriction portion 81B. The second portion of the restriction portion 81B comprises a small protrusion extending upward from the front end thereof.

In this sixth modified embodiment, the frame 31 comprises a restriction wall 45 extending from the inner face of the right wall 38 toward the film 44 in the width direction 51. The frame 31 also comprises a guide wall 46 extending from the inner face of the right wall 38 toward the film 44 in the width direction 51. The upper surface of the guide wall 46 is a guide surface 47 extending forward and downward.

The movable member (anchor, detection portion, light blocking portion) 70C has a circular contour in a cross-section along the insertion-removal direction 50 and the vertical direction. For instance, the movable member (anchor, detection portion, light blocking portion) 70C may have a spherical shape, a circular cylindrical shape, or a circular cylindrical tube shape.

Referring to FIG. 14A, when the operation portion 82 is in the first position, the movable member (anchor, detection portion, light blocking portion) 70C is positioned on the second portion of the restriction portion 81B, such that the movement of the movable member (anchor, detection portion, light blocking portion) 70C is restricted within a restricted range between the restriction wall 45 and the small protrusion extending upward from the front end of the second portion of the restriction portion 81B.

Referring to FIG. 14B, when the operation portion 82 is moved from the first position to the second position by the hollow tube 102, the restriction portion 81B moves in the removal direction 55 relative to the frame 31, but the movable member (anchor, detection portion, light blocking portion) 70C cannot move in the removal direction 55 relative to the frame 31 because the restriction wall 45 contacts the movable member (anchor, detection portion, light blocking portion) 70C. Therefore, the movable member (anchor, detection portion, light blocking portion) 70C climbs over the small protrusion of the second portion of the restriction portion 81B, and subsequently rolls down on the guide surface 47 in a free range below the restricted range. As a result, the movable member (anchor, detection portion, light blocking portion) 70C reaches the detection position. A transit time between when the movable member (anchor, detection portion, light blocking portion) 70C is released to when the sensor 103 outputs the Low-level signal is measured, similarly to the second modified embodiment.

Seventh Modified Embodiment

Figure 15A:
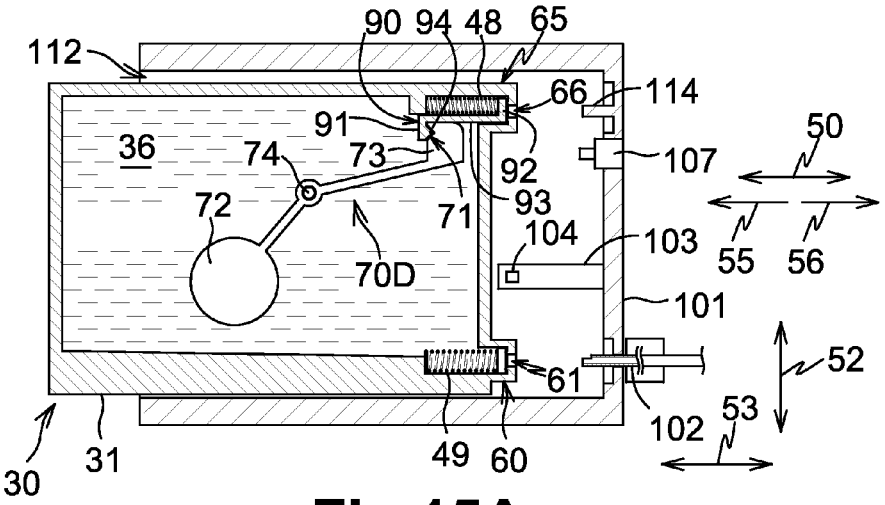
FIG. 15A is a cross-sectional view of an ink cartridge and a cartridge mounting portion according to a seventh modified embodiment during insertion of the ink cartridge into the cartridge mounting portion.
Figure 15B:
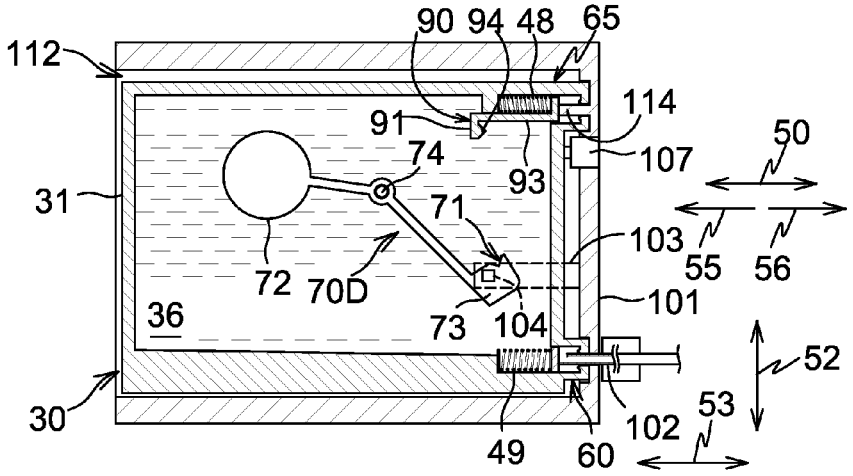
FIG. 15B is a cross-sectional view of the ink cartridge and the cartridge mounting portion according to the seventh modified embodiment when mounting of the ink cartridge to the cartridge mounting portion has been completed and a detection portion is in a detection position.
Figure 15C:
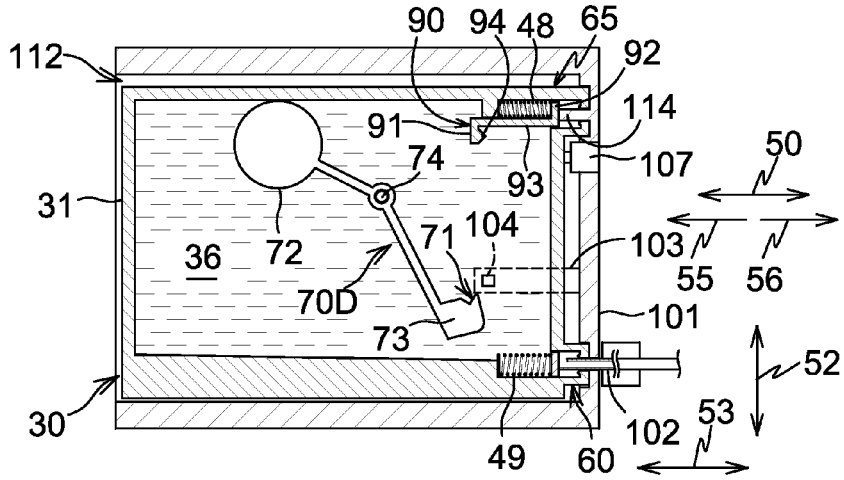
FIG. 15C is a cross-sectional view of the ink cartridge and the cartridge mounting portion according to the seventh modified embodiment when mounting of the ink cartridge to the cartridge mounting portion has been completed and the detection portion has passed the detection position.

Referring to FIGS. 15A to 15C, an ink cartridge 30 and a cartridge mounting portion 110 according to a seventh modified embodiment are described. The ink cartridge 30 comprises an air communication portion 65 configured to bring the ink chamber 36 into fluid communication with the atmosphere outside the ink cartridge 30. The air communication portion 65 is positioned above the ink supply portion 60 and the sensor 103 and extends from the front outer face of the front wall 40 of the frame 31 in the insertion direction 56. For instance, the air communication portion 65 may have a cylindrical shape. The air communication portion 65 has a proximal end at the front wall 40 and a distal end opposite the proximal end. The air communication portion 65 has an air communication opening 66 formed at the distal end. The air communication portion 65 has an inner space and the inner space can be in fluid communication with the exterior of the ink cartridge 30 via the air communication opening 66. The inner space of the air communication portion 65 is in fluid communication with the inner space of the frame 31, i.e., the ink chamber 36, at the proximal-end side. The ink chamber 36 can be in fluid communication with the exterior of the ink cartridge 30 via the air communication portion 65. In this description, when it is described that the air communication opening 66 is provided at the front wall 40, it at least means that the air communication opening 66 penetrates through the front wall 40, or that the air communication opening 66 is provided at the distal end of the air communication portion 65 extending from the front wall 40 in the insertion direction 56, or that the air communication opening 66 is provided at a distal end of an protrusion extending from the front wall 40 in the removal direction 55.

In this seventh modified embodiment, the ink cartridge 30 comprises a movable member 70D instead of the movable member 70. The movable member 70D comprises a detection portion 73 and a float 72. In this seventh modified embodiment, the movable member 70D comprises the detection portion 73 at a first end of the movable member 70D and the float 72 at a second end of the movable member 70D. The detection portion 73 is positioned closer to the front wall 40 than the float 72 is. The float 72 has a specific gravity which is less than the specific gravity of ink stored in the ink chamber 36, similarly to the above-described embodiment. The ink cartridge 30 comprises a shaft 74 extending from the inner face of the right wall 38 toward the film 44 in the width direction 51. The movable member 70D is pivotally supported by the shaft 74 at a position between the detection portion 73 and the float 72. The movable member 70D is configured to pivot about a pivot axis, e.g. about the shaft 74, in the clockwise direction and counter-clockwise direction in FIGS. 15A to 15C. The detection portion 73 comprises the recessed portion 71 at its wall surface facing the removal direction 55, similarly to the above-described embodiment.

The detection portion 73 comprises a light blocking portion, similarly to the above-described embodiment, configured to block the light emitted by the light emitting portion 104 of the sensor 103.

The ink cartridge 30 comprises a restriction member 90, and the restriction member 90 comprises a restriction portion 91, an operation portion 92, and a connection portion 93 connected to the restriction portion 91 and the operation portion 92. The operation portion 92 extends upward from a front end of the connection portion 93 which extends in the depth direction 53. The operation portion 92 comprises a front surface facing in the insertion direction 56, and the front surface of the operation portion 92 faces the air communication opening 66 of the air communication portion 65 in the depth direction 53. The operation portion 92 is movable between a first position as shown in FIG. 15A and a second position as shown in FIG. 15B. The second position is closer to the rear outer face of the rear wall 41 than the first position is. When the operation portion 92 is in the first position, the operation portion 92 contacts a wall surrounding the air communication opening 66 and thereby closes the air communication opening 66. When the operation portion 92 is in the second position, the operation portion 92 is positioned away from the wall surrounding the air communication opening 66 and thereby opens the air communication opening 66. The operation portion 92 is operable from the exterior of the ink cartridge 30. In this seventh modified embodiment, the operation portion 92 is operable by a longitudinal object, e.g., a rod 114, via the air communication opening 66. When the rod 114 is inserted into the air communication portion 65 through the air communication opening 66, the rod 114 pushes the operation portion 92 from the first position to the second position in the removal direction 55.

The restriction portion 91 extends downward from a rear end of the connection portion 93. The restriction portion 91 comprises a front surface facing in the insertion direction 56 and a protrusion 94 extending from the front surface in the insertion direction 56. When the operation portion 92 is in the first position, the protrusion 94 engages with the recessed portion 71 of the detection portion (light blocking portion) 73, such that the movement of the float 72 is restricted within a restricted range. When the float 72 is in the restricted range, the float 72 is submerged in ink.

When the operation portion 92 is in the second position, the protrusion 94 is positioned away from the recessed portion 71 and thereby the restriction portion 91 releases the movable member 70D, such that the float 72 is positioned in a free range which is above the restricted range.

The ink cartridge 30 further comprises a coil spring 48. The coil spring 48 has a first end contacting a surface of the frame 31 facing in the insertion direction 56 in the ink chamber 36 and a second end contacting a rear surface of the operation portion 92 facing in the removal direction 55. The coil spring 48 is configured to bias the operation portion 92 in the insertion direction 56 into the first position. The coil spring 48 is an example of a biasing member and can be replaced with a leaf spring, resin spring, etc.

In this seventh modified embodiment, the restriction portion 81 and the connection portion 83 are omitted, and the operation portion 82 is replaced with a valve configured to selectively open and close the ink supply opening 61. The coil spring 49 is configured to bias the valve, such that the valve closes the ink supply opening 61, similarly to the third modified embodiment.

In this seventh modified embodiment, the cartridge mounting portion 110 comprises the rod 114 extending from the end surface of the case 101 in the removal direction 55. The rod 114 is positioned in a position corresponding to the air communication portion 65. During the insertion of the ink cartridge 30 into the cartridge mounting portion 110, the rod 114 enters the air communication portion 65 via the air communication opening 66 and pushes the operation portion 92 in the removal direction 55 from the first position to the second position. When this occurs, the movable member 70D is released, and the ink chamber 36 is brought into fluid communication with the atmosphere.

When the movable member 70D is released, the movable member 70D pivots about the shaft 74 in the clockwise direction from the position shown in FIG. 15A to the position shown in FIG. 15C via the position shown in FIG. 15B. More specifically, the float 72 moves upward in the free range, and the detection portion (light blocking portion) 73 moves downward. After this occurs, as the ink stored in the ink chamber 36 is consumed, the surface of the ink lowers and the movable member 70D pivots about the shaft 74 in the counter-clockwise from the position shown in FIG. 15C to the position shown in FIG. 15A (nevertheless, the restriction portion 91 does not contact the recessed portion 71) via the position shown in FIG. 15B. More specifically, the float 72 moves downward in the free range following the lowering surface of ink, and the detection portion (light blocking portion) 73 moves upward.

The controller 130 performs the processes of FIG. 7 when the movable member 70D pivots about the shaft 74 in the clockwise direction from the position shown in FIG. 15A to the position shown in FIG. 15C via the position shown in FIG. 15B. The controller 130 performs the processes of FIG. 8 when the movable member pivots about the shaft 74 in the counter-clockwise from the position shown in FIG. 15C to the position shown in FIG. 15A (nevertheless, the restriction portion 91 does not contact the recessed portion 71) via the position shown in FIG. 15B

Eighth Modified Embodiment

Figure 16A:
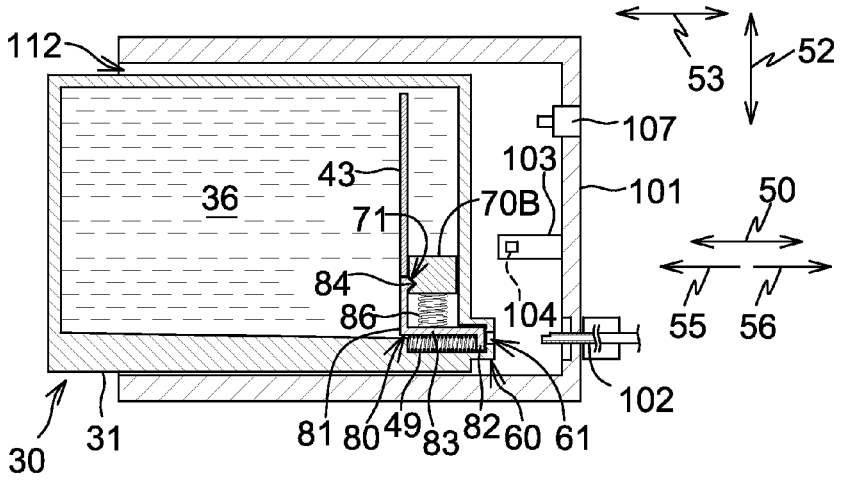
FIG. 16A is a cross-sectional view of an ink cartridge and a cartridge mounting portion according to an eighth modified embodiment during insertion of the ink cartridge into the cartridge mounting portion.
Figure 16B:
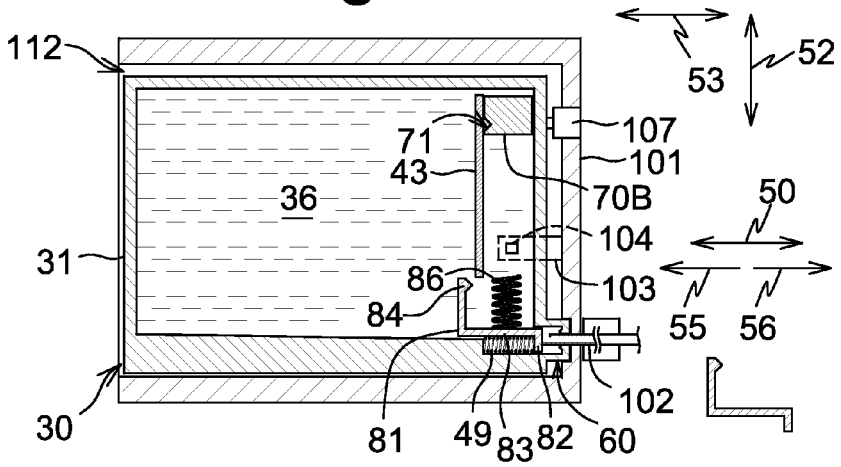
FIG. 16B is a cross-sectional view of the ink cartridge and the cartridge mounting portion according to the eighth modified embodiment when mounting of the ink cartridge to the cartridge mounting portion has been completed and a movable member is at the upper end of a moving path.
Figure 16C:
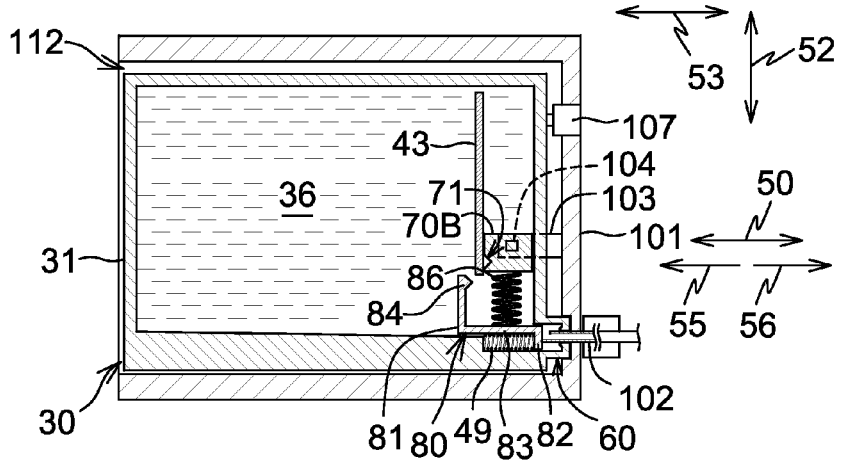
FIG. 16C is a cross-sectional view of the ink cartridge and the cartridge mounting portion according to the eighth modified embodiment when mounting of the ink cartridge to the cartridge mounting portion has been completed and the movable member is at the lower end of the moving path.

Referring to FIGS. 16A to 16C, an ink cartridge 30 and a cartridge mounting portion 110 according to an eight modified embodiment are described. The difference between this eighth modified embodiment and the above-describe embodiment is that the ink cartridge 30 of this eighth modified embodiment comprises the movable member 70B of the fifth modified embodiment instead of the movable member 70 and also comprises a biasing member, e.g., a coil spring 86 disposed between the connection portion 83 and the movable member 70B. Referring to FIG. 16A, when the movement of the movable member (anchor, detection portion, light blocking portion) 70B is restricted by the restriction portion 81 within a restricted range, the coil spring 86 biases the movable member (anchor, detection portion, light blocking portion) 70B upward. Referring to FIG. 16B, when the movable member (anchor, detection portion, light blocking portion) 70B is released, the movable member (anchor, detection portion, light blocking portion) 70B is launched by the biasing force of the coil spring 86 and moves upward in a free range which is above the restricted range, passing the detection position along the way. Subsequently, referring to FIG. 16C, the movable member (anchor, detection portion, light blocking portion) 70B moves downward in the free range due to its own weight and returns to the detection position. In this eighth modified embodiment, the controller 130 may measure a transit time from when the movable member (anchor, detection portion, light blocking portion) 70B passes the detection position to when the movable member (anchor, detection portion, light blocking portion) 70B returns to the detection position. In other words, the controller 130 measures a time required for the movable member (anchor, detection portion, light blocking portion) 70B to move between two portions in the moving path of the movable member (anchor, detection portion, light blocking portion) 70B, but the two points are the same point.

Ninth Modified Embodiment

Figure 17A:
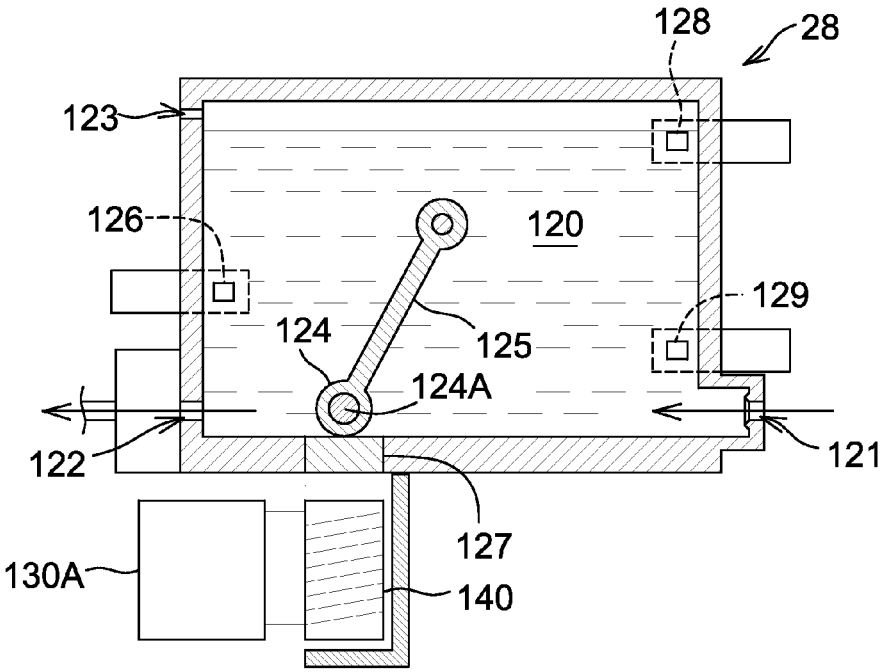
FIG. 17A is a cross-sectional view of a sub tank according to a ninth modified embodiment before electric current is applied to an electromagnet.
Figure 17B:
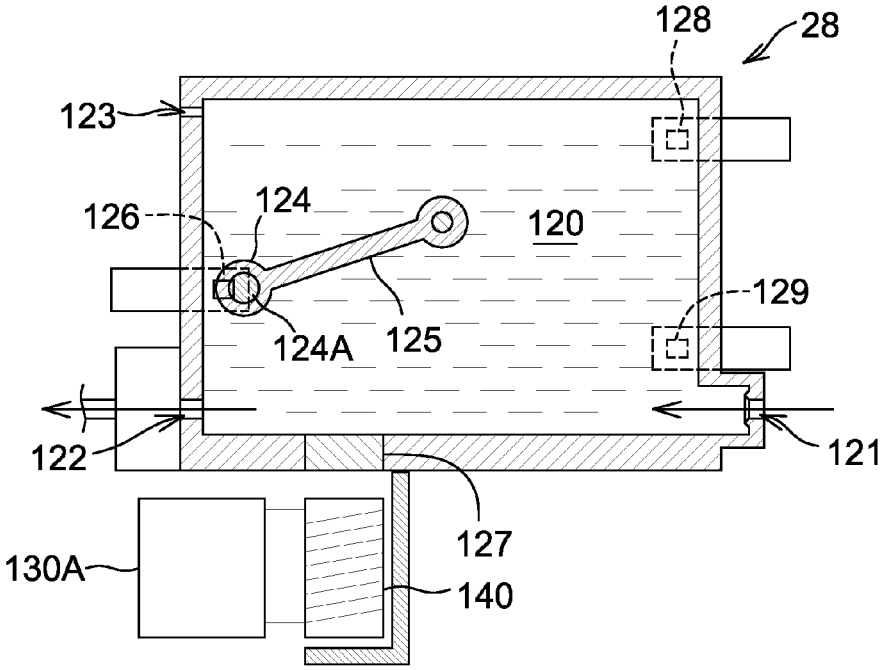
FIG. 17B is a cross-sectional view of the sub tank according to the ninth modified embodiment after electric current is applied to the electromagnet.

Referring to FIGS. 17A and 17B, a liquid container e.g., a sub tank 28 according to a ninth modified embodiment is described. The sub tank 28 according to the ninth modified embodiment comprises a liquid chamber, e.g., an ink chamber 120, an ink introduction opening 121, a liquid supply opening, e.g., an ink supply opening 122, an air communication opening 123, a movable member 125, a detection portion 124, a sensor 126, a magnetic material, e.g., a metal plate 127, and ink surface sensors 128, 129. The ink introduction opening 121 is connected to the cartridge mounting portion 110 via the ink tube 20. The ink supply opening 122 is connected to the recording head 21 via an ink tube (not shown).

The sub tank 28 is configured to receive ink coming via the ink introduction opening 121, and store the ink in the ink chamber 120. The sub tank 28 is configured to supply the ink stored in the ink chamber 120 to the recording head 21 via the ink supply opening 122. The air communication opening 123 is configured to bring the ink chamber 120 into fluid communication with the atmosphere outside the sub tank 28. The ink surface sensors 128, 129 are configured to detect the position of the surface of ink stored in the ink chamber 120.

The movable member 125 is positioned in the ink chamber 120. The detection portion 124 comprises a magnet, preferably a permanent magnet 124A. The detection portion 124 is an anchor having a specific gravity which is greater than the specific gravity of the ink stored in the ink chamber 120. The movable member 125 has a first end and a second end, and the detection portion 124 is provided at the first end of the movable member 125. The second end of the movable member 125 is pivotally supported by the sub tank 28 in the ink chamber 120. The movable member 125 is configured to pivot about the second end in the clockwise direction and the counter-clockwise direction in FIGS. 17A and 17B.

The sensor 126 is provided at a position facing the moving path of the detection portion 124. The sensor 126 has the same structure as the sensor 103. The metal plate 127 is in an outer wall of the sub tank 28. The metal plate 127 is positioned adjacent to the moving path of the detection portion 124. More specifically, the metal plate 127 is buried in the outer wall of the sub tank 28, and the sensor 126 is positioned above the metal plate 127. The printer 10 comprises an electromagnet 140 and a current supply circuit 130A configured to supply electric current to the electromagnet 140. The electromagnet 140 is positioned outside the sub tank 28 at a position adjacent to the metal plate 127. The current supply circuit 130A is configured to be controlled by the controller 130 and thereby configured to selectively supply electric current to the electromagnet 140 for the electromagnet 140 to produce a magnetic field.

Referring to FIG. 17A, when electric current is not supplied to the electromagnet 140, the movement of the detection portion 124 is restricted within a restricted range by an attracting force between the permanent magnet 124A and the metal plate 127. When an electric current is applied to the electromagnet 140 from the current supply circuit 130A, the electromagnet 140 produces a repulsive force between the permanent magnet 124A and the metal plate 127, which repulsive force is greater than the attracting force. When this occurs, referring to FIG. 17B, the detection portion 124 is launched by the repulsive force and moves upward in a free range which is above the restricted range. When the detection portion 124 moves upward, the movable member 125 pivots about the second end of the movable member 125. Subsequently, the detection portion 124 reaches the detection position.

When the supply of the electric current to the electromagnet 140 is stopped, the detection portion 124 moves downward and the movement of the detection portion 124 is again restricted within the restricted range. With the sub tank 28 according to this ninth modified embodiment, the transit time for estimating the viscosity of ink can be measured a plurality of times if needed. The controller 130 according to this ninth modified embodiment may measure a time from when the electric current is supplied to the electromagnet 140 to when the sensor 126 outputs the Low-level signal as the transit time. The structure of this ninth modified embodiment can be applied not only to the sub tank 28 but also to the ink cartridge 30.

In the above-described embodiment and the first to ninth modified embodiment, the ink cartridge 30 is manually mounted to the cartridge mounting portion 110. Nevertheless, how to mount the ink cartridge 30 to the cartridge mounting portion 110 is not limited to the manual mounting. An auto-loading mechanism can be provided to the cartridge mounting portion 110 as describe below for example.

Tenth Modified Embodiment

Figure 18A:
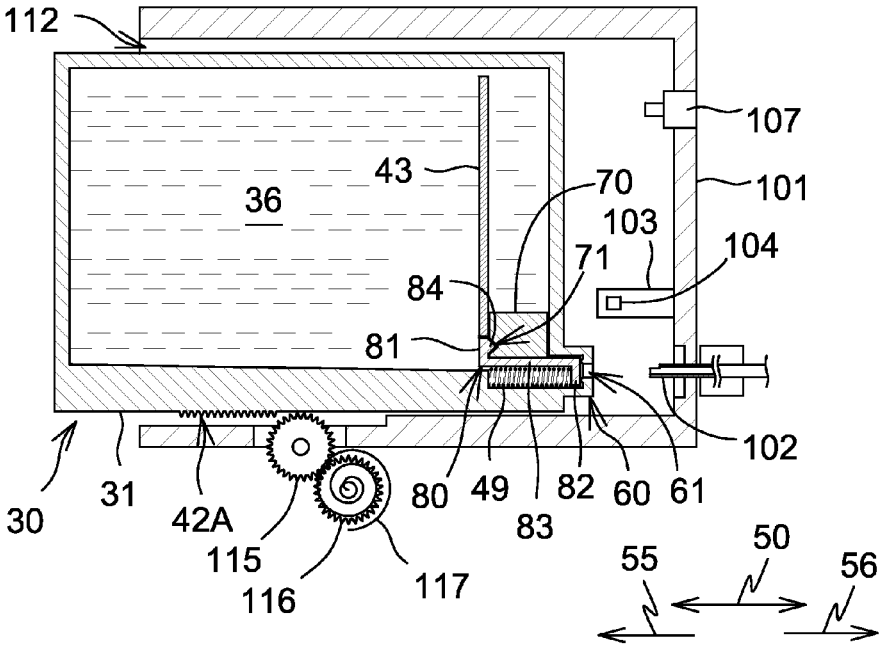
FIG. 18A is a cross-sectional view of an ink cartridge and a cartridge mounting portion according to a tenth modified embodiment before a rack gear is engaged with a pinion gear.
Figure 18B:
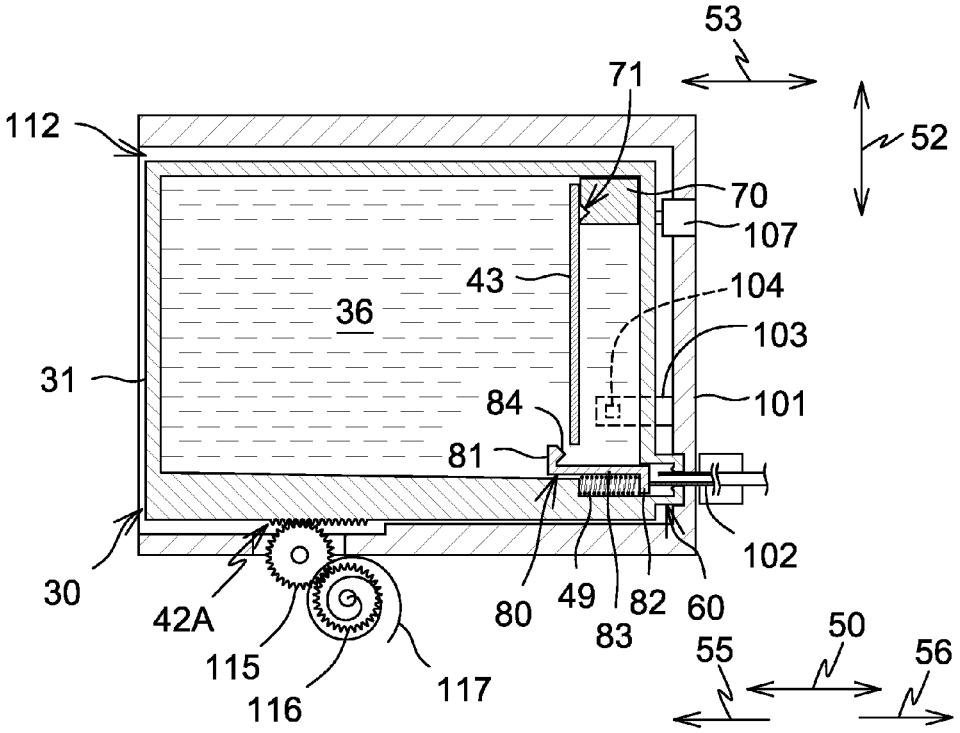
FIG. 18B is a cross-sectional view of the ink cartridge and the cartridge mounting portion according to the tenth modified embodiment after the rack gear is engaged with the pinion gear.

Referring to FIGS. 18A and 18B, an ink cartridge 30 and a cartridge mounting portion 110 according to a tenth modified embodiment are described. The ink cartridge 30 comprises a rack gear 42A on the outer face of the bottom wall 42. The cartridge mounting portion 110 comprises a pinion gear 115 configured to engage with the rack gear 42A, a drive gear 116 engaging with the pinion gear 115, and a spiral spring 117. One end of the spiral spring 117 contacts the drive gear 116, and the spiral spring 117 is configured to apply driving force to the drive gear 116.

Before the ink cartridge 30 is mounted to the cartridge mounting portion 110, the spiral spring 117 is locked in a state in which the spiral spring 117 is tightly wound as shown in FIG. 18A, so that energy is stored in the spiral spring 117. When the ink cartridge 30 is inserted into the cartridge mounting portion 110 by a user, the rack gear 42A contacts and rotates the pinion gear 115. When the pinion gear 115 rotates, the drive gear 116 rotates and thereby the spiral spring 117 is unlocked. When the spiral spring 117 is unlocked, the winding of the spiral spring 117 loosens and the spiral spring 117 applies the driving force to the drive gear 116. When the driving force is applied to the drive gear 116, the drive gear 116 rotates and the pinion gear 115 rotates. When the pinion gear 115 rotates, the rack gear 42A moves in the insertion direction 56 toward the end surface of the case 101 of the cartridge mounting portion 110. As a result, the ink cartridge 30 moves in the insertion direction 56 toward the end surface of the case 101 of the cartridge mounting portion 110, i.e., the user does not need to insert the ink cartridge 30 anymore, and the mounting of the ink cartridge 30 to the cartridge mounting portion 110 is completed as shown in FIG. 18B. In other words, the mounting of the ink cartridge 30 to the cartridge mounting portion 110 is done automatically.

After ink stored in the ink cartridge 30 is used up, when a user wishes to remove the ink cartridge 30 from the cartridge mounting portion 110, the user pulls the ink cartridge 30 in the removal direction 55. When the ink cartridge 30 moves in the removal direction 55, each of the pinion gear 115 and the drive gear 116 rotates in a direction which is opposite to the direction in which each of the pinion gear 115 and the drive gear 116 rotates when the ink cartridge 30 moves in the insertion direction 56. As a result, the spiral spring 117 is again tightly wound. Subsequently, at a timing when the rack gear 42A separates from the pinion gear 115, the tightly wound spiral spring 117 is locked.

According to this tenth modified embodiment, a user has only to insert the ink cartridge 30 to a position in which the rack gear 42A and the pion gear 115 engages. Afterwards, the ink cartridge 30 automatically moves in the insertion direction 56, and finally the mounting of the ink cartridge 30 to the cartridge mounting portion 110 is completed. Therefore, there is a reduced likelihood that the sensor 103 cannot detect the movable member (float, detection portion, light blocking portion) 70 even if the movable member (float, detection portion, light blocking portion) 70 is released. The measurement of the transit time can be done more securely.

Eleventh Modified Embodiment

Figure 19A:
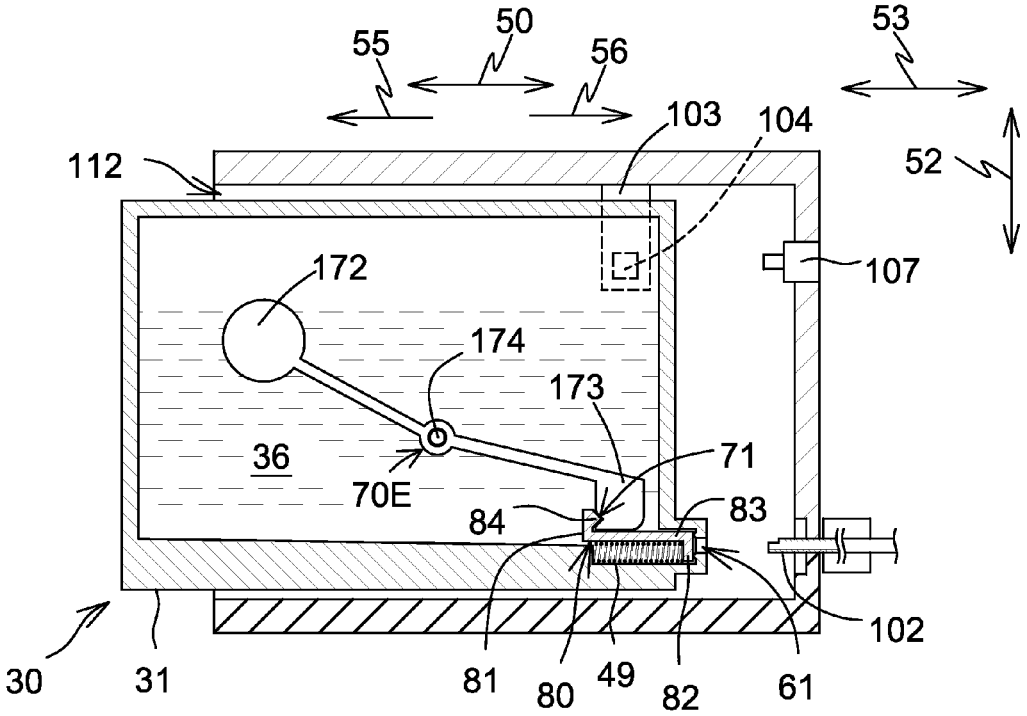
FIG. 19A is a cross-sectional view of an ink cartridge and a cartridge mounting portion according to an eleventh modified embodiment during insertion of the ink cartridge into the cartridge mounting portion.
Figure 19B:
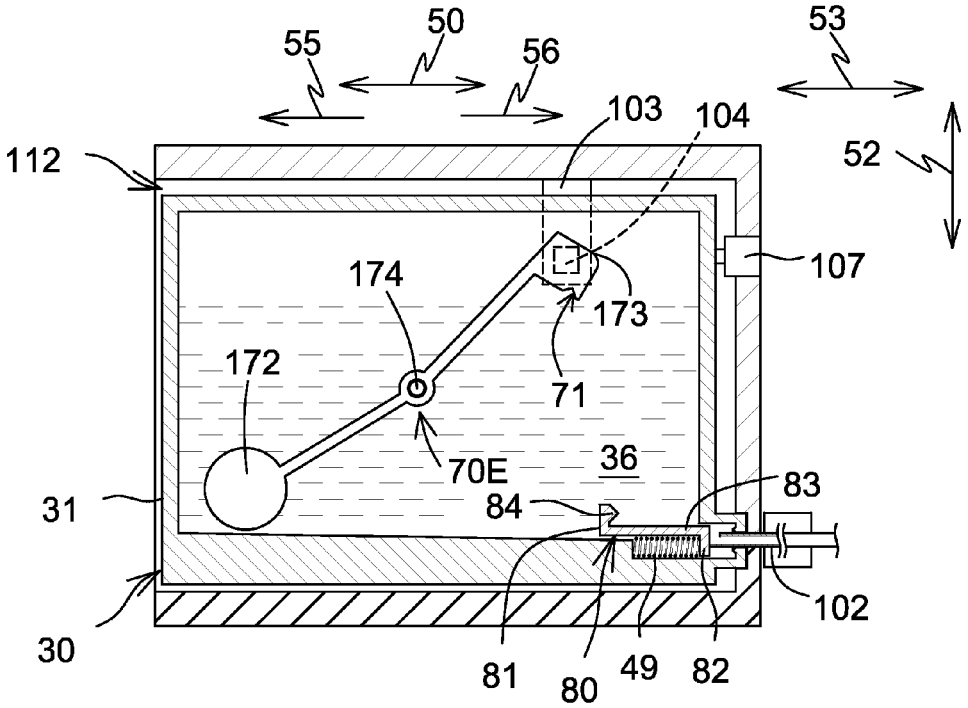
FIG. 19B is a cross-sectional view of the ink cartridge and the cartridge mounting portion according to the eleventh modified embodiment when mounting of the ink cartridge to the cartridge mounting portion has been completed.

Referring to FIGS. 19A and 19B, an ink cartridge 30 and a cartridge mounting portion 110 according to an eleventh modified embodiment are described. The difference between this eleventh modified embodiment and the above-describe embodiment is that the ink cartridge 30 of this eleventh modified embodiment comprises a movable member 70E instead of the movable member 70 and the sensor 103 extends from the ceiling of the case 101 in this eleventh modified embodiment.

The movable member 70E comprises a detection portion 173 and an anchor 172. The movable member 70E comprises the detection portion 173 at a first end of the movable member 70E and the anchor 172 at a second end of the movable member 70E. The detection portion 173 is positioned closer to the front wall 40 than the anchor 172 is. The anchor 172 has a specific gravity which is greater than the specific gravity of ink stored in the ink chamber 36, similarly to the above-described fifth modified embodiment. The ink cartridge 30 comprises a shaft 174 extending from the inner face of the right wall 38 toward the film 44 in the width direction 51. The movable member 70E is pivotally supported by the shaft 174 at a position between the detection portion 173 and the anchor 172. The movable member 70E is configured to pivot about a pivot axis, e.g. about the shaft 174, in the counter-clockwise direction in FIGS. 19A and 19B. The detection portion 173 comprises the recessed portion 71 at its wall surface facing the removal direction 55, similarly to the above-described embodiment.

The detection portion 173 comprises a light blocking portion, similarly to the above-described embodiment, configured to block the light emitted by the light emitting portion 104 of the sensor 103.

When the operation portion 82 is in the first position, the protrusion 84 engages with the recessed portion 71 of the detection portion (light blocking portion) 173, such that the movement of the anchor 172 is restricted within a restricted range. When the operation portion 82 is in the second position, the protrusion 84 is positioned away from the recessed portion 71 and thereby the restriction portion 81 releases the movable member 70E, such that the anchor 172 is positioned in a free range which is below the restricted range.

When the movable member 70E is released, the movable member 70E pivots about the shaft 174 in the counter-clockwise direction from the position shown in FIG. 19A to the position shown in FIG. 19B. More specifically, the anchor 172 moves downward in the free range, and the detection portion (light blocking portion) 173 moves upward. Finally, the anchor 172 contacts the bottom surface of the ink chamber 36 and the detection portion (light blocking portion) 173 reaches the detection position, and the movable member 70E stops the movement.

In this eleventh embodiment, the controller 130 determines whether the detection signal output from the mount sensor 107 changes from the signal indicating that the ink cartridge 30 is not in the mount position to the signal indicating that the ink cartridge 30 is in the mount position at step S2 in the flowchart of FIG. 7. Moreover, the controller 130 determines whether the detection signal output from the sensor 103 changes from the High-level signal to the Low-level signal at step S5 in the flowchart of FIG. 7, similarly to the above-described second modified embodiment. That is, the controller 130 measures a time required for the movable member 70E to move from the position shown in FIG. 19A to the position shown in FIG. 19B.

In this eleventh modified embodiment, the initial position of the ink surface in the ink chamber 36 is below the sensor 103, i.e., below the detection position, and the ink may comprise a colorant, e.g., a pigment, which blocks light. Because the ink surface does not reach the detection position, the ink does not affect the detection of the detection portion (light blocking portion) 173 even if the ink comprises such a colorant.

Twelfth Modified Embodiment

Figure 20A:
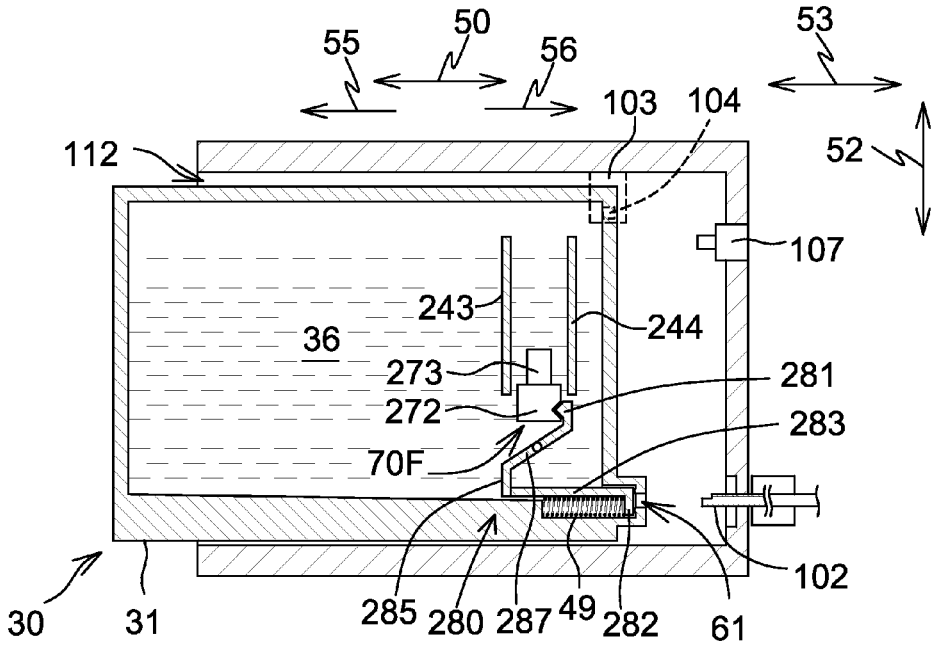
FIG. 20A is a cross-sectional view of an ink cartridge and a cartridge mounting portion according to a twelfth modified embodiment during insertion of the ink cartridge into the cartridge mounting portion.
Figure 20B:
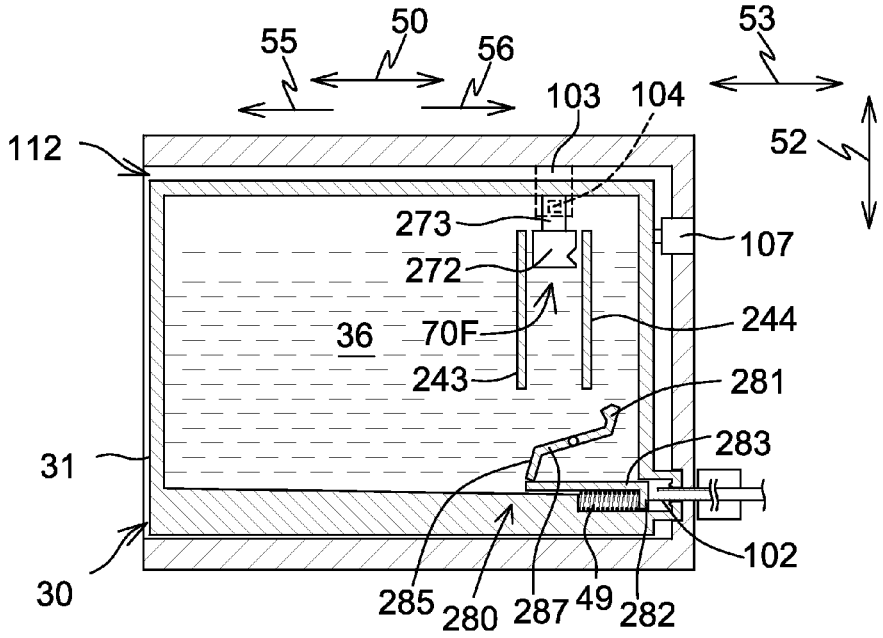
FIG. 20B is a cross-sectional view of the ink cartridge and the cartridge mounting portion according to the twelfth modified embodiment when mounting of the ink cartridge to the cartridge mounting portion has been completed.

Referring to FIGS. 20A and 20B, an ink cartridge 30 and a cartridge mounting portion 110 according to a twelfth modified embodiment are described. The difference between this twelfth modified embodiment and the above-describe embodiment is that the ink cartridge 30 of this twelfth modified embodiment comprises a movable member 70F instead of the movable member 70 and comprises a restriction member 280 instead of the restriction member 80. Moreover, the sensor 103 extends from the ceiling of the case 101 in this twelfth modified embodiment, similarly to the above-described eleventh modified embodiment. Furthermore, the ink cartridge 30 of this twelfth modified embodiment comprises a pair of guide walls 243, 244 instead of the portioning wall 43.

The movable member 70F comprises a detection portion 273 and a float 272. The detection portion 273 extends from the upper end of the float 272. The float 272 has a specific gravity which is less than the specific gravity of ink stored in the ink chamber 36, similarly to the above-described embodiment. The detection portion 273 comprises a light blocking portion, similarly to the above-described embodiment, configured to block the light emitted by the light emitting portion 104 of the sensor 103. The float 272 comprises a recessed portion at its wall surface facing the insertion direction 56.

The restriction member 280 comprises an operation portion 282, a thrust portion 283, a rise portion 285, a connection portion 287, and a restriction portion 281. The operation portion 282 and the thrust portion 283 are a first integral member, and the rise portion 285, the connection portion 287, and the restriction portion 281 are a second integral member, which is separate from the first integral member.

The operation portion 282 extends downward from a front end of the thrust portion 283 which extends in the depth direction 53. The operation portion 282 comprises a front surface facing the insertion direction 56, and the front surface of the operation portion 282 faces the ink supply opening 61 in the depth direction 53. The operation portion 282 is movable between a first position as shown in FIG. 20A and a second position as shown in FIG. 20B. The second position is closer to the rear outer face of the rear wall 41 than the first position is. When the operation portion 282 is in the first position, the operation portion 282 contacts a wall surrounding the ink supply opening 61 and thereby closes the ink supply opening 61. When the operation portion 282 is in the second position, the operation portion 282 is positioned away from the wall surrounding the ink supply opening 61 and thereby opens the ink supply opening 61. The operation portion 282 is operable from the exterior of the ink cartridge 30. In this twelfth modified embodiment, the operation portion 282 is operable by the hollow tube 102 via the ink supply opening 61. When the hollow tube 102 is inserted into the ink supply portion 60 through the ink supply opening 61, the hollow tube 102 pushes the operation portion 282 from the first position to the second position in the removal direction 55.

When the operation portion 282 is in the first position, a rear end of the thrust portion 283 contacts a front surface of the rise portion 285 facing the insertion direction 56. The connection portion 287 extends from the rise portion 285 forward and upward and the restriction portion 281 is positioned at an end of the connection portion 287 opposite the rise portion 285. The restriction portion 281 comprises a rear surface facing the removal direction 55 and a protrusion extending from the rear surface in the removal direction 55. The connection portion 287 is configured to pivot about a pivot axis positioned between the rise portion 285 and the restriction portion 281, in the clockwise direction and the counter-clockwise direction in FIGS. 20A and 20B.

When the operation portion 282 is in the first position, the protrusion of the restriction portion 281 engages with the recessed portion of the float 272 of the movable member 70F, such that the movement of the float 272 is restricted within a restricted range. When the float 272 is in the restricted range, the float 272 is submerged in ink.

When the operation portion 82 moves from the first position to the second position, the thrust portion 283 moves in the removal direction 55 and pushes up the rise portion 285. The thrust 283 then slides under the rise portion 285. When this occurs, the connection portion 287 pivots about the pivot axis in the clockwise direction in FIG. 20A, and the protrusion of the restriction portion 281 moves away from the recessed portion of the float 272.

Therefore, when the operation portion 282 is in the second position, the restriction portion 81 releases the movable member 70F, such that the float 272 is positioned in a free range which is above the restricted range.

Each of the guide walls 243, 244 extends from the inner surface of the right wall 38 in the width direction 51 toward the left side of the frame 31. Each of the guide walls 243, 244 extends in the height direction 52. The guide walls 243, 244 extend substantially in parallel with each other. The right wall 38, the guide walls 243, 244 and the film 44 define a space therein, and the space is an example of the free range.

The coil spring 49 has a first end contacting a surface of the frame 31 facing in the insertion direction 56 in the ink chamber 36 and a second end contacting a rear surface of the operation portion 282 facing in the removal direction 55. The coil spring 49 is configured to bias the operation portion 282 in the insertion direction 56 into the first position.

When the movable member 70F is released, the movable member 70F moves upward from the position shown in FIG. 20A to the position shown in FIG. 20B. More specifically, the movable member 70F moves upward in the free range between the guide walls 243, 244. Finally, the detection portion (light blocking portion) 273 reaches the detection position, and the movable member 70F stops movement. When the movable member 70F stops movement, the detection portion (light blocking portion) 273 contacts the inner surface of the top wall 39, and/or a portion of the float 272 is exposed from the surface of ink.

In this twelfth embodiment, the controller 130 determines whether the detection signal output from the mount sensor 107 changes from the signal indicating that the ink cartridge 30 is not in the mount position to the signal indicating that the ink cartridge 30 is in the mount position at step S2 in the flowchart of FIG. 7. Moreover, the controller 130 determines whether the detection signal output from the sensor 103 changes from the High-level signal to the Low-level signal at step S5 in the flowchart of FIG. 7, similarly to the above-described second modified embodiment. That is, the controller 130 measures a time required for the movable member 70F to move from the position shown in FIG. 20A to the position shown in FIG. 20B.

In this twelfth modified embodiment, the initial position of the ink surface in the ink chamber 36 is below the sensor 103, i.e., below the detection position, and the ink may comprise a colorant, e.g., a pigment, which blocks light, similarly to the above-described eleventh modified embodiment.

In the above-described embodiment and the first to twelfth modified embodiments, ink is an example of liquid. Nevertheless, liquid is not limited to ink. For instance, liquid can be pre-treatment liquid which is ejected onto the sheet of paper before ink is ejected in printing.

While the invention has been described in connection with various example structures and illustrative embodiments, it will be understood by those skilled in the art that other variations and modifications of the structures and embodiments described above may be made without departing from the scope of the invention. Other structures and embodiments will be understood by those skilled in the art from a consideration of the specification or practice of the invention disclosed herein. It is intended that the specification and the described examples are merely illustrative and that the scope of the invention is defined by the following claims.

The invention claimed is:

1. A liquid consuming apparatus comprising:

a liquid container comprising:

a liquid chamber configured to store liquid;

a liquid supply opening selectively providing fluid communication from the liquid chamber to an exterior of the liquid chamber;

a movable member positioned in the liquid chamber and comprising a detection portion, wherein when the movable member moves, the detection portion moves in a moving path; and a restriction member configured to restrict movement of the movable member in the liquid chamber by directly contacting the movable member, the restriction member being movable between a first position and a second position such that the restriction member engages the movable member when the restriction member is in the first position and the restriction member does not engage the movable member when the restriction member is in the second position;

a liquid consuming portion configured to consume liquid supplied from the liquid container via the liquid supply opening;

a release member configured to move the restriction member and release the movable member from restriction by the restriction member, the release member including a liquid supply tube extending into the liquid supply opening, wherein the restriction member is configured to be moved from the first position to the second position by the supply tube when the supply tube is received in the liquid supply opening;

a detector configured to output a detection signal based on presence or absence of the detection portion in a detection position in the moving path; and a controller configured to:

measure, based on the detection signal output from the detector, a physical quantity, based on which a velocity of the detection portion moving in the moving path when the movable member moves through liquid stored in the liquid chamber can be specified; and determine whether the physical quantity is within a threshold range.

2. The liquid consuming apparatus of claim 1, wherein the controller is configured to measure, as the physical quantity, a transit time required for the detection portion to move between two points in the moving path.

3. The liquid consuming apparatus of claim 2, further comprising a mounting portion, wherein the liquid container is configured to be removably mounted to the mounting portion, wherein the release member is configured to release the movable member from the restriction by the restriction member when the liquid container is mounted to the mounting portion.

4. The liquid consuming apparatus of claim 3, wherein the liquid stored in the liquid chamber has a first specific gravity and the movable member comprises a float having a second specific gravity which is less than the first specific gravity.

5. The liquid consuming apparatus of claim 4, wherein the controller is further configured to:

determine that an amount of the liquid stored in the liquid chamber becomes less than a threshold amount when the detector outputs the detection signal indicating that the detection portion is in the detection position after determining whether the physical quantity is within the threshold range; and notify that the amount of the liquid stored in the liquid chamber becomes less than the threshold amount when determining that the amount of the liquid stored in the liquid chamber becomes less than the threshold amount.

6. The liquid consuming apparatus of claim 3, wherein the detector is configured to selectively output a first detection signal indicating that the detection portion is in the detection position and a second detection signal indicating that the detection portion is not in the detection position, and the controller is configured to measure, as the transit time, a time from when the detector outputs the first detection signal to when the detector outputs the second detection signal.

7. The liquid consuming apparatus of claim 3, wherein the controller is further configured to determine whether the restriction of the movable member is released, and the controller is configured to measure, as the transit time, a time from when the controller determines that the restriction of the movable member is released to when the detector outputs the detection signal indicating that the detection portion is in the detection position.

8. The liquid consuming apparatus of claim 7, further comprising a mount detector positioned in a mount detection position in an insertion path of the ink container into the mounting portion and configured to output a mount detection signal based on presence or absence of the ink container in the mount detection position, wherein the controller is configured to determine that the restriction of the movable member is released when the mount detector outputs the mount detection signal indicating that the ink cartridge is in the mount detection position.

9. The liquid consuming apparatus of claim 3, wherein the liquid container is configured to be inserted into the mounting portion in an insertion direction and be removed from the mounting portion in a removal direction opposite the insertion direction, wherein the liquid container further comprises a front wall oriented toward the insertion direction when the liquid container is inserted into the mounting portion and a rear wall oriented toward the removal direction when the liquid container is removed from the mounting portion, wherein the liquid chamber is positioned between the front wall and the rear wall, wherein the liquid supply opening is provided at the front wall, wherein the restriction member comprises an operation portion and a restriction portion, wherein the operation portion is operable from the exterior of the liquid chamber and movable between a first position and a second position, and the second position is closer to the rear wall than the first position is, wherein when the operation portion is in the first position, the operation portion is configured to close the liquid supply opening, wherein when the operation portion is in the second position, the operation portion is configured to open the liquid supply opening, wherein the restriction portion is configured to contact the movable member in the liquid chamber such that the movement of the movable member is restricted, wherein the liquid container further comprises a biasing member configured to bias the operation portion into the first position, wherein the release member is a hollow tube provided at the mounting portion and configured to be inserted through the liquid supply opening, wherein when the hollow tube is inserted through the liquid supply opening, the hollow tube is configured to push the operation portion from the first position to the second position against a biasing force of the biasing member.

10. The liquid consuming apparatus of claim 3, wherein the restriction member is a gas bag filled with gas, wherein the gas bag is configured to change its state from a bulging state to a contracted state, wherein when the gas bag is in the bulging state, the gas bag bulges into the liquid chamber and contacts the movable member in the liquid chamber such that movement of the float is restricted within a restricted range and the float is submerged in the liquid in the liquid chamber, wherein when the gas bag is in the contracted state, the gas bag is configured to release the movable member such that the float is positioned in a free range which is above the restricted range, wherein an amount of gas in the gas bag when the gas bag is in the contracted state is less than an amount of gas in the gas bag when the gas bag is in the bulging state, wherein the release member is configure to discharge gas from the gas bag.

11. The liquid consuming apparatus of claim 3, wherein the liquid container is configured to be inserted into the mounting portion in an insertion direction and be removed from the mounting portion in a removal direction opposite the insertion direction, wherein the liquid container further comprises a front wall oriented toward the insertion direction when the liquid container is inserted into the mounting portion and a rear wall oriented toward the removal direction when the liquid container is removed from the mounting portion, wherein the liquid chamber is positioned between the front wall and the rear wall, the liquid container further comprises an air communication opening provided at the front wall and configured to bring the liquid chamber into fluid communication with atmosphere outside the liquid chamber, wherein the restriction member comprises an operation portion and a restriction portion, wherein the operation portion is operable from the exterior of the liquid chamber and movable between a first position and a second position, and the second position is closer to the rear wall than the first position is, wherein when the operation portion is in the first position, the operation portion is configured to close the air communication opening, wherein when the operation portion is in the second position, the operation portion is configured to open the air communication opening, wherein the restriction portion is configured to contact the movable member in the liquid chamber such that the movement of the movable member is restricted, wherein the liquid container further comprises a biasing member configured to bias the operation portion into the first position, wherein the release member is a longitudinal object provided at the mounting portion, wherein the longitudinal object is configured to push the operation portion from the first position to the second position against a biasing force of the biasing member.

12. The liquid consuming apparatus of claim 3, wherein the detector comprises a light emitting portion and a light receiving portion positioned so as to face each other with the liquid container positioned therebetween, wherein the detector is configured to output different detection signals based on whether or not intensity of light received by the light receiving portion is greater than or equal to a threshold value, wherein the detection portion comprises a first light blocking portion, a second light blocking portion, and a light passing portion, wherein the light passing portion is positioned between the first light blocking portion and the second light blocking portion with respect to the moving path, wherein the controller is configured to determine a type of the liquid container based on a combination of detection signals output from the detector when the detection portion passes the detection position.

13. The liquid consuming apparatus of claim 1, wherein the liquid stored in the liquid chamber has a first specific gravity and the movable member comprises an anchor having a third specific gravity which is greater than the first specific gravity.

14. The liquid consuming apparatus of claim 13, wherein the liquid container further comprises a biasing member configured to bias the anchor upward when the movement of the movable member is restricted by the restriction member.

15. The liquid consuming apparatus of claim 13, further comprising a mounting portion, wherein the liquid container is configured to be inserted into the mounting portion in an insertion direction and be removed from the mounting portion in a removal direction opposite the insertion direction, wherein the liquid container comprises a guide surface positioned in the liquid chamber, wherein the anchor has a circular contour in a cross-section along the insertion direction, the removal direction, and a vertical direction, wherein when the movable member is released, the anchor rolls down on the guide surface.

16. The liquid consuming apparatus of claim 4, wherein the movable member is configured to pivot about a pivot axis and comprises a first end and a second end, wherein the detection portion is positioned at the first end and the float is positioned at the second end.

17. The liquid consuming apparatus of claim 1, wherein the movable member comprises a magnet, and the restriction member comprises a magnetic material, wherein the release member is an electromagnet configured to produce a repulsive force between the magnet and the magnetic material, wherein the repulsive force is greater than an attracting force between the magnet and the magnetic material.

18. The liquid consuming apparatus of claim 1, further comprising a temperature sensor configured to output a signal based on temperature, wherein the controller is configured to determine the threshold range based on the signal output from the temperature sensor.

19. The liquid consuming apparatus of claim 2, wherein the controller is configured to notify information about the liquid container when the controller determines that the transit time is not within the threshold range.

20. The liquid consuming apparatus of claim 2, wherein the controller is configured to restrict consumption of liquid by the liquid consuming portion when the controller determines that the transit time is not within the threshold range.

21. The liquid consuming apparatus of claim 3, wherein the liquid consuming portion comprises a nozzle and an actuator configured to eject liquid through the nozzle when receiving driving voltage, wherein the controller is configured to control the liquid consuming portion, such that the driving voltages applied to the actuator are adjusted for amounts of ink ejected from the nozzle to be the same amount between when the controller determines that the transit time is within the threshold range and when the controller determines that the transit time is not within the threshold range.

22. A liquid consuming apparatus, comprising:

a liquid container including a liquid chamber configured to store liquid and a liquid supply opening selectively providing fluid communication from the liquid chamber to an exterior of the liquid chamber;

a movable member positioned in the liquid chamber;

a restriction member movable between a first position and a second position, wherein the restriction member engages the movable member when the restriction member is in the first position such that movement of the movable member is restricted within a restricted range in the liquid chamber, and wherein the restriction member does not engage the movable member when the restriction member is in the second position such that the movable member is movable beyond the restricted range in the liquid chamber;

a mounting portion including a liquid supply tube extending into the liquid supply opening, wherein the restriction member is configured to be moved from the first position to the second position by the supply tube when the supply tube is received in the liquid supply opening.

23. The liquid consuming apparatus of claim 22, further comprising:

a detector configured to output a detection signal based on presence or absence of a detection portion in a detection position in the moving path; and a controller configured to measure, based on the detection signal output from the detector, a physical quantity based on which a velocity of the movable member moving in the moving path can be specified, and determine whether the physical quantity is within a threshold range.

24. A liquid storage method, comprising:

providing a liquid container having a liquid chamber, wherein the liquid chamber includes a liquid supply opening selectively providing a fluid flow passage from the liquid chamber to an exterior of the liquid chamber;

storing liquid in the liquid chamber;

providing a movable member in the liquid chamber;

restricting movement of the member movable within a restricted range in the liquid chamber;

mounting the liquid container to a liquid consuming apparatus, including receiving a liquid supply tube into the liquid supply opening, wherein the movable member is movable beyond the restricted range in the liquid chamber in response to the liquid supply tube being received into the liquid supply opening.

25. The method of claim 24, further comprising:

measuring a physical quantity based on which a velocity of the movable member moving in the moving path can be specified, and determining whether the physical quantity is within a threshold range.

26. The liquid consuming apparatus of claim 1, wherein the controller is configured to measure the physical quantity while the liquid level in the liquid chamber is unchanged.

* * * * *